US011993994B2

(12) United States Patent
Schultz et al.

(10) Patent No.: US 11,993,994 B2
(45) Date of Patent: May 28, 2024

(54) JARRING TOOL AND METHOD OF USE

(71) Applicant: THRU TUBING SOLUTIONS, INC., Newcastle, OK (US)

(72) Inventors: Roger L. Schultz, Newcastle, OK (US); Brock W. Watson, Sadler, TX (US); Gary P. Funkhouser, Moore, OK (US); Gregory A. Kliewer, Edmond, OK (US)

(73) Assignee: THRU TUBING SOLUTIONS, INC., Newcastle, OK (US)

( * ) Notice: Subject to any disclaimer, the term of this patent is extended or adjusted under 35 U.S.C. 154(b) by 308 days.

(21) Appl. No.: 17/298,138

(22) PCT Filed: Dec. 23, 2019

(86) PCT No.: PCT/US2019/068368
§ 371 (c)(1),
(2) Date: May 28, 2021

(87) PCT Pub. No.: WO2020/146143
PCT Pub. Date: Jul. 16, 2020

(65) Prior Publication Data

US 2021/0396088 A1 Dec. 23, 2021

Related U.S. Application Data

(60) Provisional application No. 62/789,423, filed on Jan. 7, 2019.

(51) Int. Cl.
*E21B 31/113* (2006.01)
*E21B 23/04* (2006.01)

(52) U.S. Cl.
CPC ..... *E21B 31/113* (2013.01); *E21B 23/04* (2013.01)

(58) Field of Classification Search
CPC ... E21B 31/107; E21B 31/113; E21B 31/1135
See application file for complete search history.

(56) References Cited

U.S. PATENT DOCUMENTS 2,690,226 A * 9/1954 Comstock ..... E21B 34/12 166/178
3,213,941 A * 10/1965 Nelson ..... E21B 31/035 175/300

(Continued)

FOREIGN PATENT DOCUMENTS

JP 2003522866 A 7/2003

OTHER PUBLICATIONS

International Search Report with Written opinion dated Apr. 23, 2020 for PCT Patent Application No. PCT/US2019/068368, 14 pages.

*Primary Examiner* — Cathleen R Hutchins
(74) *Attorney, Agent, or Firm* — Smith IP Services, P.C.

(57) ABSTRACT

A jarring tool can include a longitudinally displaceable piston, a first fluid chamber having a volume that decreases in response to displacement of the piston, a flow controller that controls flow of fluid between the first fluid chamber and a second fluid chamber, and a plug seat secured to the piston. A method of applying a jarring force can include applying a pressure differential across a plug in a jarring tool, the plug restricting flow from a first flow passage section to a second flow passage section, then increasing a flow rate of fluid from the first flow passage section. Another jarring tool can include an outer housing with a longitudinal flow passage and seal surfaces at opposite ends of the outer housing, and a flow obstruction, fluid flow through the flow passage being increased in response to application of a pressure differential across the obstruction.

34 Claims, 17 Drawing Sheets

(56) References Cited

U.S. PATENT DOCUMENTS

| | | | | |
|---|---|---|---|---|
| 2004/0055744 | A1 | 3/2004 | Zheng et al. | |
| 2015/0369003 | A1* | 12/2015 | Hajjari | F16K 25/005 166/373 |
| 2016/0102514 | A1 | 4/2016 | Miller et al. | |
| 2016/0258254 | A1 | 9/2016 | Guo et al. | |
| 2018/0283123 | A1* | 10/2018 | Baudoin | E21B 31/1135 |

* cited by examiner

JARRING TOOL AND METHOD OF USE

CROSS-REFERENCE TO RELATED APPLICATIONS

This application is a national stage under 35 USC 371 of International Application No. PCT/US19/68368 filed on 23 Dec. 2019, which claims priority to U.S. Application No. 62/789,423 filed on 7 Jan. 2019. The entire disclosures of these prior applications are incorporated herein by this reference.

TECHNICAL FIELD

This disclosure relates generally to equipment utilized and operations performed in conjunction with a subterranean well and, in some examples described below, more particularly provides for retrieval of equipment stuck in a well, and other uses of a jarring tool in a well.

BACKGROUND

It can be useful to be able to apply a jarring force to equipment in a well. For example, the jarring force could be used to free the equipment if it has become stuck in the well. As another example, the jarring force could be used to produce some displacement of all or a portion of the equipment, such as, to actuate the equipment or to produce another desired result.

It will, therefore, be readily appreciated that improvements are continually needed in the art of constructing and utilizing jarring tools for use in wells. These improvements could be useful in situations where it is desired to free equipment stuck in a well, to produce displacement of all or a portion of the equipment, or to produce another desired result.

DETAILED DESCRIPTION

Figure 1:
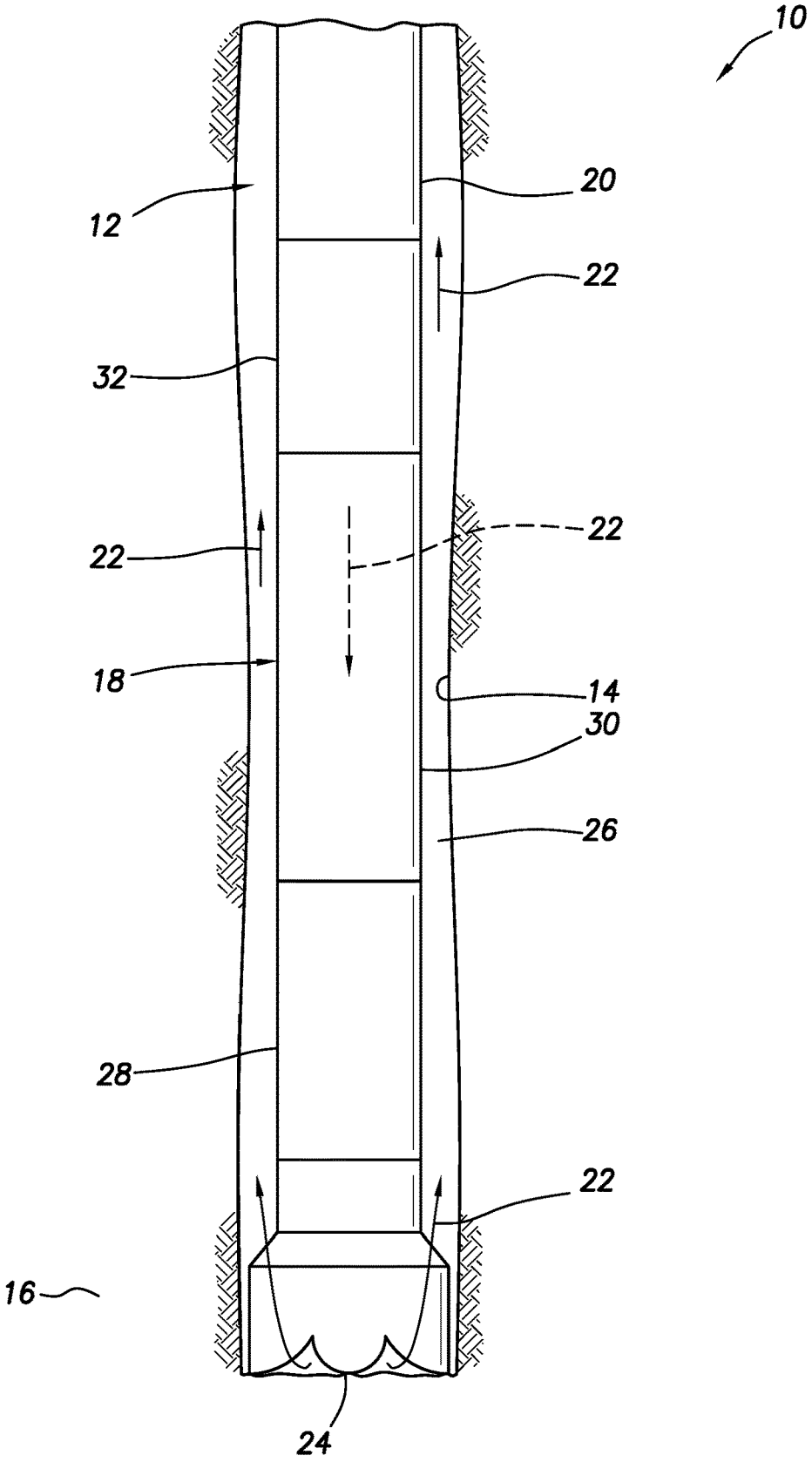
FIG. 1 is a representative partially cross-sectional view of an example of a well system and associated method which can embody principles of this disclosure.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a generally tubular drill string 12 is being used to drill a wellbore 14 into an earth formation 16. The drill string 12 comprises a bottom hole assembly 18 connected at a distal end of a tubular string 20.

The tubular string 20 in this example could comprise drill pipe, coiled tubing or another type of tubular string. The tubular string 20 may be used to direct fluid flow to the bottom hole assembly 18, and to convey the bottom hole assembly into and out of the wellbore 14.

In an example drilling operation, fluid 22 can be flowed through the tubular string 20 from surface. The fluid 22 can flow through the bottom hole assembly 18 and exit via nozzles of a drill bit 24. The fluid 22 can then flow back to the surface via an annulus 26 formed between the drill string 12 and the wellbore 14.

In this example, the bottom hole assembly 18 includes the drill bit 24, a drill motor 28, a drill collar 30 and a jarring tool 32. In other examples, other or different tools could be included in the bottom hole assembly 18. The scope of this disclosure is not limited to use of any particular tools or combination of tools in a bottom hole assembly, or to use of a bottom hole assembly at all.

Drilling operations can be performed with the jarring tool 32 connected as part of the bottom hole assembly 18, since relatively unrestricted flow of the fluid 22 through the jarring tool 32 is permitted prior to activation of the jarring tool. When activated, the jarring tool 32 can be used to free the bottom hole assembly 18 in the event that the bottom hole assembly becomes stuck in the wellbore 14.

Note that it is not necessary for the same tubular string 20 to be used to direct fluid 22 flow to the bottom hole assembly 18, to convey the bottom hole assembly into and out of the wellbore 14, and to retrieve the bottom hole assembly from the wellbore after it has become stuck in the wellbore. For example, after the bottom hole assembly 18 has become stuck in the wellbore, the tubular string used to convey the bottom hole assembly into the wellbore 14 could be disconnected and retrieved to surface, and then another tubular string including the jarring tool 32 could be deployed into the wellbore 14 to free the bottom hole assembly.

In some examples described below, the jarring tool 32 is deployed into the tubular string 20 after the tubular string or other equipment has become stuck in the wellbore 14. Thus, it is not necessary for the jarring tool 32 to be connected in the tubular string 20 at the time the tubular string is installed in the wellbore 14.

In some examples, the principles of this disclosure may be used in well operations other than drilling operations (such as, stimulation, completion, or production operations, etc.). Thus, the scope of this disclosure is not limited to use of the jarring tool 32 in drilling operations.

Figure 2A:
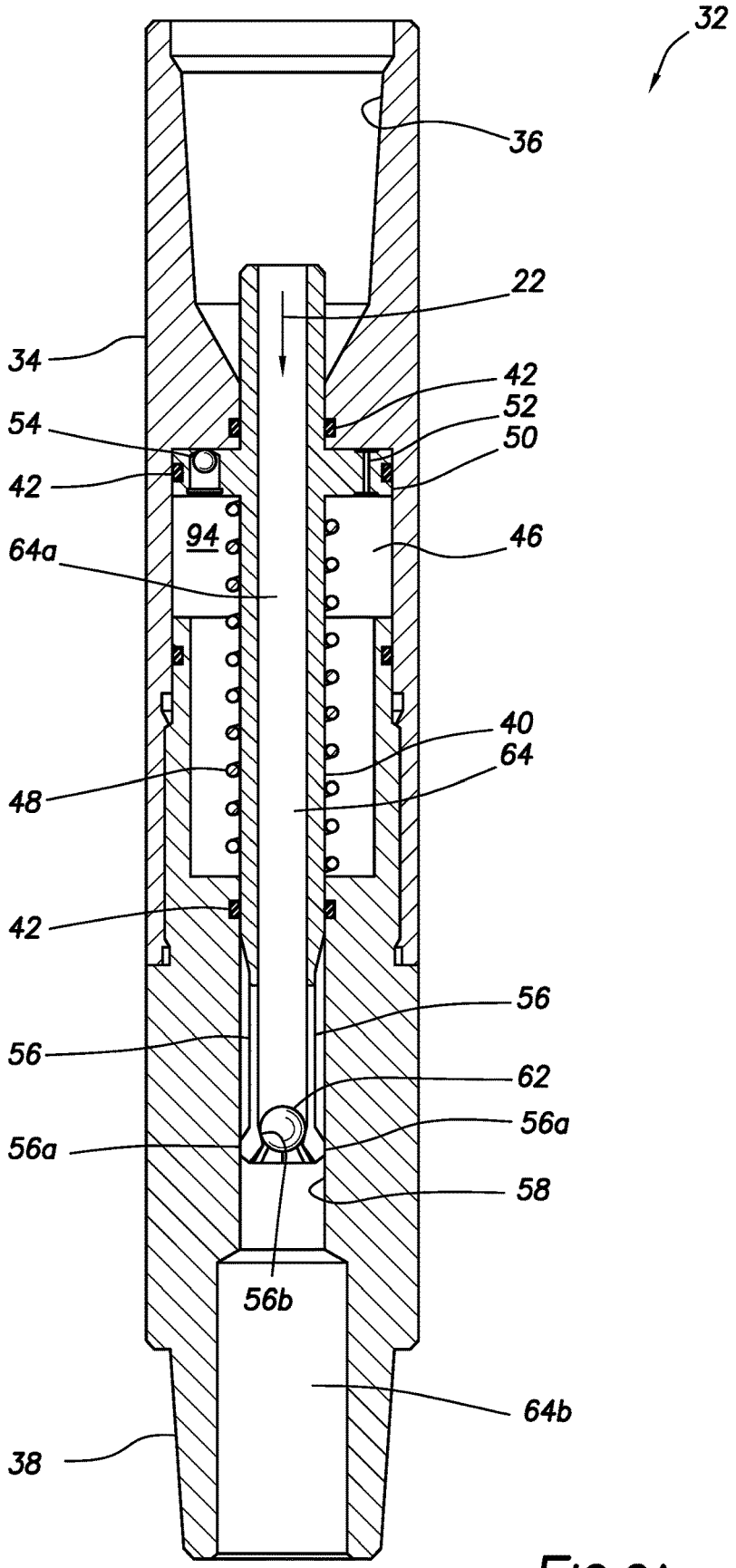
FIGS. 2A & B are representative cross-sectional views of an example of a jarring tool that may be used in the system and method of FIG. 1, in unactivated and activated configurations.

Referring additionally now to FIGS. 2A & B, an example of the jarring tool 32 that may be used in the system 10 and method of FIG. 1 is representatively illustrated. The FIGS. 2A & B jarring tool 32 may be used with other systems and methods, in keeping with the principles of this disclosure.

Figure 2B:
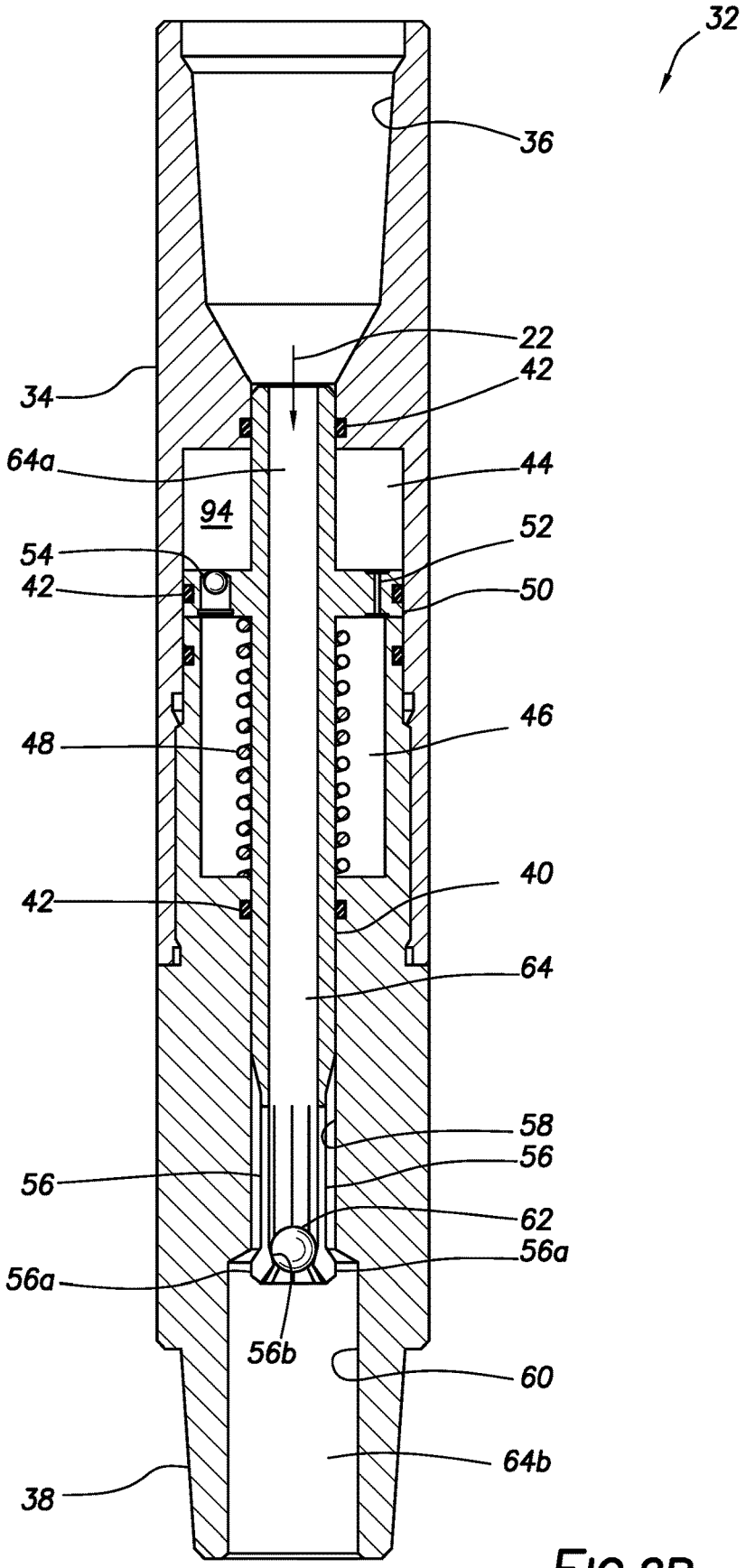

In FIG. 2A, the jarring tool 32 is depicted prior to activation. In FIG. 2B, the jarring tool 32 is depicted during activation. The jarring tool 32 can be activated multiple times in a single trip into a well.

In this example, the jarring tool 32 includes a two-piece outer housing 34 having threaded connectors 36, 38 at its opposite ends. The connectors 36, 38 allow the jarring tool 32 to be connected as part of the tubular string 20 or bottom hole assembly 18 in the FIG. 1 system.

A generally tubular mandrel 40 is reciprocably disposed in the outer housing 34. Seals 42 isolate an upper fluid-filled chamber 44 and a lower fluid-filled chamber 46 formed between the mandrel 40 and the outer housing 34. A fluid 94 (such as a hydraulic fluid) is contained in the chambers 44, 46.

A radially enlarged piston 50 is formed on the mandrel 40. The piston 50 divides the upper fluid chamber 44 from the lower fluid chamber 46. In this example, the mandrel 40 and piston 50 are integrally formed as a single component, but in other examples the mandrel and piston could be separate components.

A spring 48 or other type of biasing device applies an upwardly directed biasing force to the mandrel 40. Thus, the piston 50 is biased in a direction in which displacement of the piston decreases a volume of the chamber 44 and increases a volume of the chamber 46.

A flow controller 52 controls flow of the fluid 94 between the chambers 44, 46. In this example, the flow controller 52 comprises a flow restrictor (such as, an orifice or a tortuous flow path) that significantly restricts the flow of fluid between the chambers 44, 46. In other examples, the flow controller 52 could comprise a pressure relief valve that prevents the flow of fluid from the chamber 46 to the chamber 44, until a predetermined pressure differential is created across the piston 50.

Another flow controller 54 controls the flow of fluid between the chambers 44, 46. In this example, the flow controller 54 comprises a check valve that permits fluid 94 flow from the chamber 44 to the chamber 46, but prevents fluid flow from the chamber 46 to the chamber 44. Other types of flow controllers (such as, a valve) may be used in other examples.

A series of circumferentially distributed and longitudinally extending resilient collets 56 are formed at a lower end of the mandrel 40. In this example, the collets 56 are integrally formed with the mandrel 40 as a single component, but in other examples the mandrel and collets could be provided as separate components.

Radially enlarged and radially reduced heads 56*a* are formed at lower ends of the collets 56. The radially inwardly reduced portions of the collet heads 56*a* form a plug seat 56*b*. As depicted in FIG. 2A, the collet heads 56*a* are slidingly received in a bore 58 formed in the outer housing 34.

This engagement between the collet heads 56*a* and the bore 58 prevents radially outward deflection of the collets 56 and radial expansion of the plug seat 56*b*. However, when the collets 56 are displaced downward, as depicted in FIG. 2B, so that the heads 56*a* are positioned in a radially enlarged bore 60 in the outer housing 34, the collets 56 can deflect radially outward and the plug seat 56*b* can radially outward expand, as described more fully below.

In the FIG. 2A unactivated configuration, the mandrel 40, piston 50 and collets 56 are in an upper position, in which a volume of the chamber 44 is at a minimum, a volume of the chamber 46 is at a maximum and the collets 56 are radially confined in the bore 58. Prior to deploying a plug 62 (such as, a ball, dart, etc.) into a flow passage 64 extending longitudinally through the jarring tool 32, the fluid 22 can flow relatively unrestricted through the jarring tool. Thus, drilling operations or other operations can be performed with the jarring tool 32 connected in the bottom hole assembly 18 or tubular string 20, with the fluid 22 permitted to flow through the flow passage 64 of the jarring tool.

However, when the plug 62 is deployed into the tubular string 20 (for example, by deploying the plug into the tubular string at the surface), flow of the fluid 22 through the flow passage 64 will become substantially restricted. The plug 62 will engage the plug seat 56*b* of the collets 56 and thereby obstruct or block the flow of the fluid 22. Continued flow of the fluid 22 will cause fluid pressure in an upper section 64*a* of the flow passage 64 to increase relative to pressure in a lower section 64*b* of the flow passage.

Note that it is not necessary for the plug 62 to completely seal off the flow passage 64 (for example, by sealingly engaging the collets 56 or plug seat 56*b*) to isolate the upper section 64*a* from the lower section 64*b*. A pressure differential across the plug 62 can still be created if restricted flow of the fluid 22 is permitted across the plug. In other examples described below, the plug 62 can completely isolate the upper flow passage section 64*a* from the lower flow passage section 64*b*, but such isolation is not necessary in keeping with the principles of this disclosure.

The pressure differential created across the plug 62 biases the mandrel 40, piston 50 and collets 56 in a downward direction. When this downward biasing exceeds the upward biasing due to the spring 48, the mandrel 40, piston 50 and collets 56 will displace downward to the activated configuration depicted in FIG. 2B.

The flow controller 52 ensures that a consistent desired pressure differential is created across the plug 62 as the mandrel 40, piston 50 and collets 56 displace downward. By restricting flow of fluid 94 from the chamber 46 to the chamber 44, the flow controller 52 prevents the mandrel 40, piston 50 and collets 56 from immediately displacing to the activated position in response to the pressure differential across the plug 62 (which may, for example, transiently spike upward when the plug engages the collet heads 56*a*).

If the flow controller 52 is a flow restrictor, then an extended amount of time will be required for the fluid 94 in the chamber 46 to flow into the chamber 44 as the piston 50 displaces downward. An operator at the surface can, thus, monitor the pressure in the upper flow passage section 64*a*, so that a desired pressure differential across the plug 62 is achieved or maintained while the jarring tool 32 is activated.

If the flow controller 52 is a pressure relief valve, then a predetermined minimum pressure differential across the piston 50 will need to be maintained (to thereby open the pressure relief valve) as the piston displaces downward and the fluid 94 flows from the chamber 46 to the chamber 44. The pressure differential across the piston 50 will correspond to a pressure differential across the plug 62, and an operator at the surface can monitor the pressure in the upper flow passage section 64*a* to ensure that the desired pressure differentials are achieved and maintained while the jarring tool 32 is activated.

In the FIG. 2B configuration, the mandrel 40, piston 50 and collets 56 have displaced downward due to the pressure differential created across the plug 62. The volume of the chamber 44 is at a maximum, the volume of the chamber 46 is at a minimum and the collets 56 are no longer radially confined in the bore 58.

The collets 56 can now deflect radially outward, thereby radially outwardly expanding the plug seat 56*b* and discharging the plug 62 into the lower flow passage section 64*b*. This discharge of the plug 62 suddenly releases the pressure previously built up in the upper flow passage section 64*a* relative to the lower flow passage section 64*b*.

The sudden conversion of potential energy (due to the pressure built up in the upper flow passage section 64*a*) to kinetic energy (in the increased flow of the fluid 22 through the passage 64) produces a jarring force in the bottom hole assembly 18 and the tubular string 20 connected to the jarring tool 32. The jarring force produced when the jarring tool 32 is activated can be used to free any equipment that had previously become stuck in the wellbore 14.

Once the pressure differential across the plug 62 is sufficiently reduced, the spring 48 will bias the mandrel 40, piston 50 and collets 56 to displace upward toward their FIG. 2A unactivated position. The flow controller 54 permits relatively unrestricted flow of fluid 94 from the chamber 44 to the chamber 46, so that the mandrel 40, piston 50 and collets 56 can readily displace upward and the jarring tool 32 is quickly "reset" from the activated configuration to the unactivated configuration.

If it is desired to again activate the jarring tool 32, another plug 62 can be deployed into the flow passage 64 and another pressure differential can be created across the plug to thereby produce another jarring force. These steps can be repeated as many times as desired to free the equipment stuck in the wellbore 14.

Figure 3A:
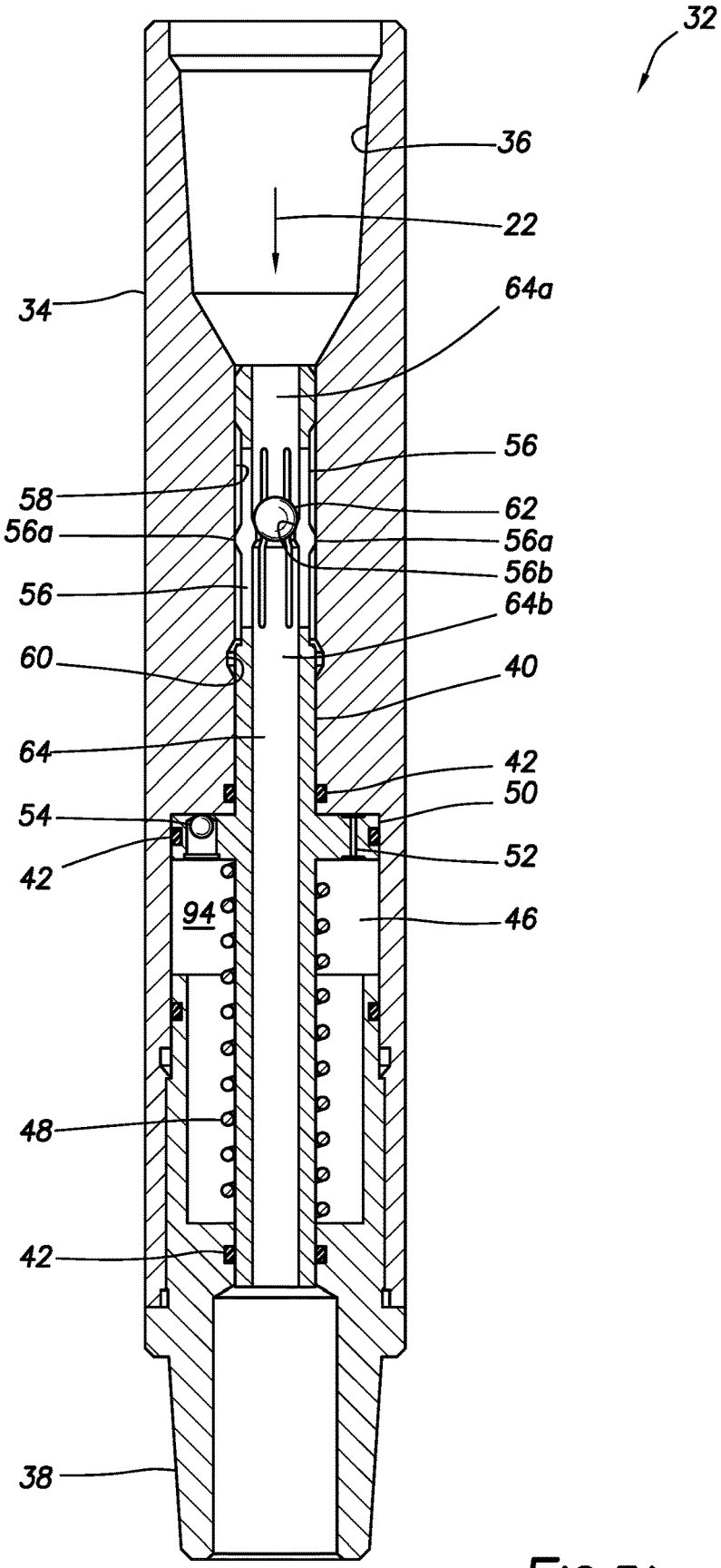
FIGS. 3A & B are representative cross-sectional views of another example of the jarring tool in unactivated and activated configurations.

Referring additionally now to FIGS. 3A & B, another example of the jarring tool 32 is representatively illustrated. The FIGS. 3A & B jarring tool 32 is similar in many respects to the FIGS. 2A & B jarring tool, and so the same reference numbers are used in FIGS. 3A & B to indicate elements similar to those described above.

The FIGS. 3A & B jarring tool 32 is configured to be connected in a tubular string or tool string, such as the bottom hole assembly 18 or tubular string 20 described above. However, in other examples the jarring tool 32 could be configured to be deployed separately into a tubular string, as described more fully below.

The FIGS. 3A & B jarring tool 32 differs from the FIGS. 2A & B jarring tool in at least one substantial respect, in that the collets 56 are formed on an upper portion of the mandrel 40, instead of at a lower end of the mandrel. When the plug 62 is deployed into the flow passage 64 in order to activate the jarring tool 32, the plug engages the plug seat 56*b* at a location above the piston 50.

Figure 3B:
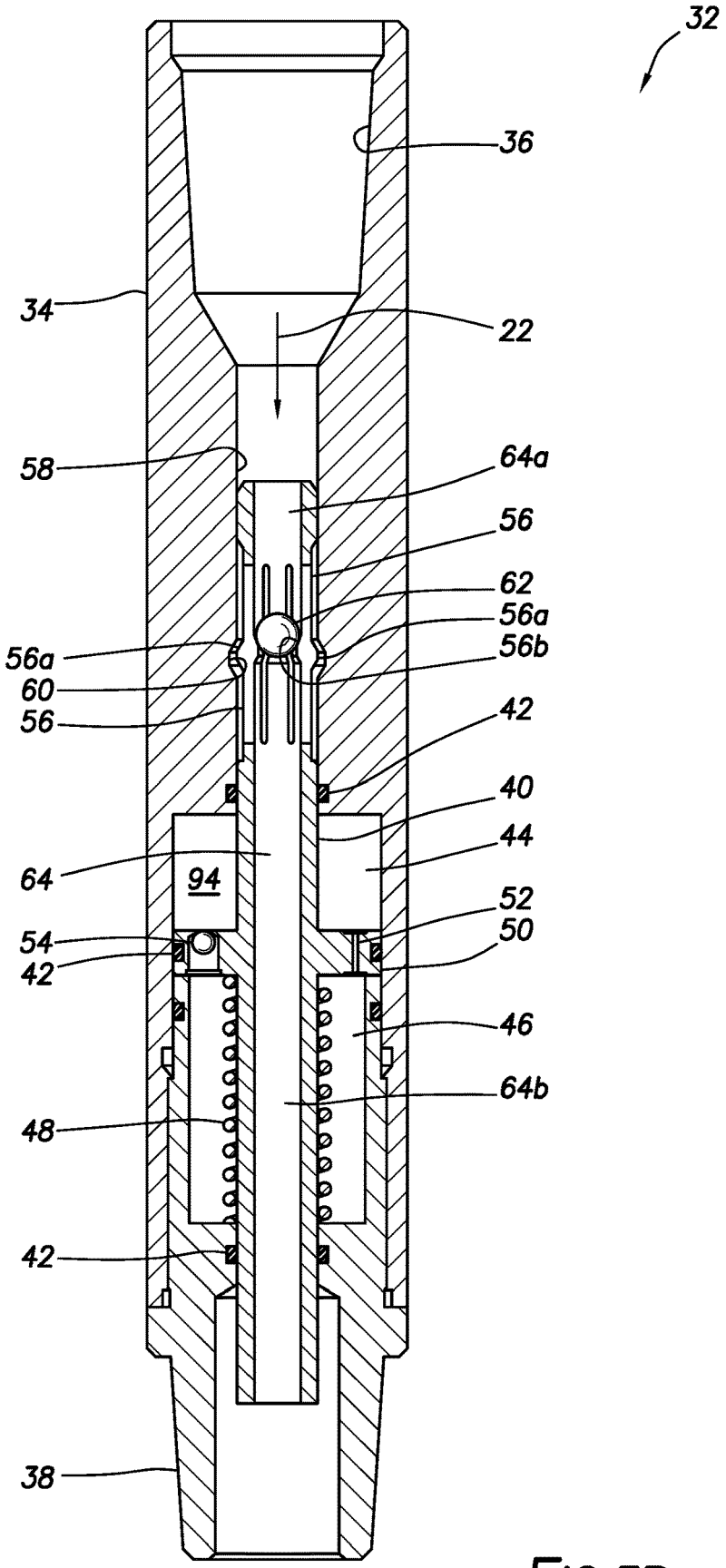

The bore 58 is likewise formed in an upper portion of the outer housing 34, as is the radially enlarged bore 60. As depicted in FIG. 3A, the collet heads 56*a* are radially constrained by the bore 58 in the unactivated configuration of the jarring tool 32. After a sufficient pressure differential has been applied across the plug 62 to displace the mandrel 40, 50 and collets 56 downward as depicted in FIG. 3B, the collet heads 56*a* are positioned in the bore 60 and are permitted to deflect radially outward in the activated configuration of the jarring tool 32.

When the collets 56 deflect radially outward (which expands the plug seat 56*b*), the plug 62 is discharged downward into the lower flow passage section 64*b*, thereby producing the jarring force by relieving the pressure differential across the plug. Another jarring force can be produced by again deploying a plug 62 into the flow passage 64 and creating a sufficient pressure differential across the plug.

Referring additionally now to FIGS. 4A-D, various examples of the jarring tool 32 are representatively illustrated. The FIGS. 4A-D examples are configured so that they can be deployed into a tubular string after the tubular string or other equipment has become stuck. Thus, the FIGS. 4A-D examples are not provided with connectors 36, 38 at opposite ends of the jarring tools 32.

Instead, each of the FIGS. 4A-D examples is provided with a seal surface 66 formed at a lower end of the outer housing 34. The seal surface 66 is configured to engage and seal against an internal shoulder or other appropriate profile formed in the tubular string into which the jarring tool 32 is deployed.

The seal surface 66 in the FIGS. 4A-D examples is curved, so that a degree of misalignment between the outer housing 34 and the tubular string internal profile can be accommodated. The seal surface 66 is spherical in these examples, but other shapes for the seal surface (such as, parabolic, frustoconical, etc.) may be used in other examples. Alternatively, a separate seal may be used to seal against an interior of the tubular string into which the jarring tool 32 is deployed.

Figure 4B:
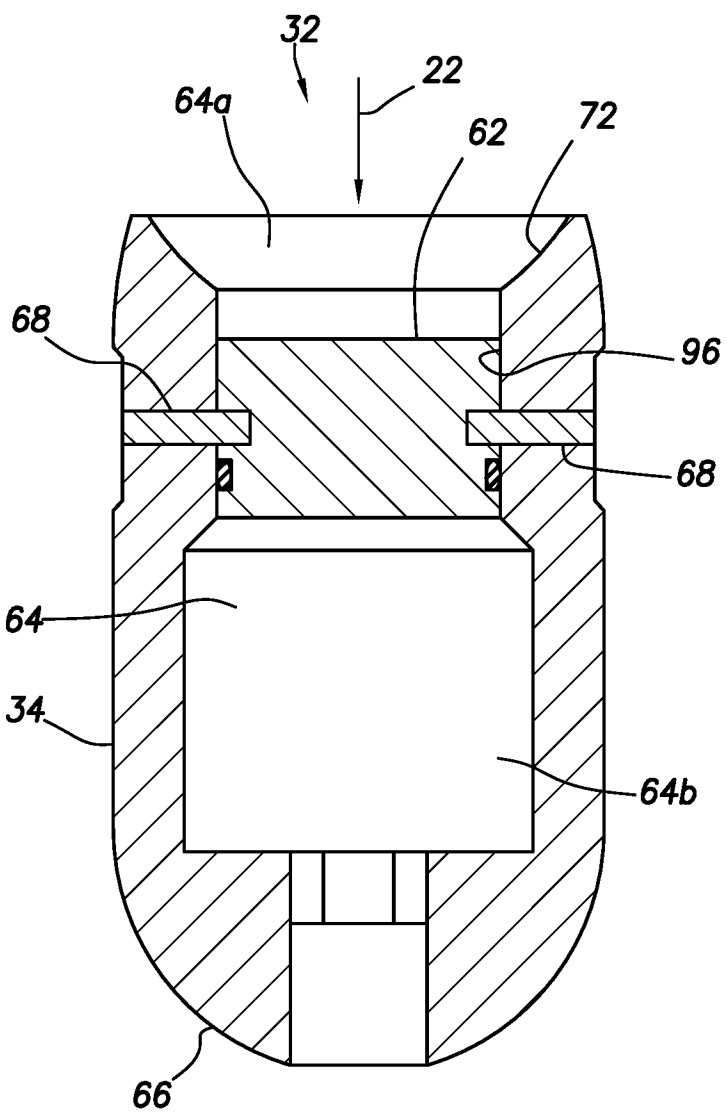
FIGS. 4A-D are representative cross-sectional views of additional examples of the jarring tool.
Figure 4A:
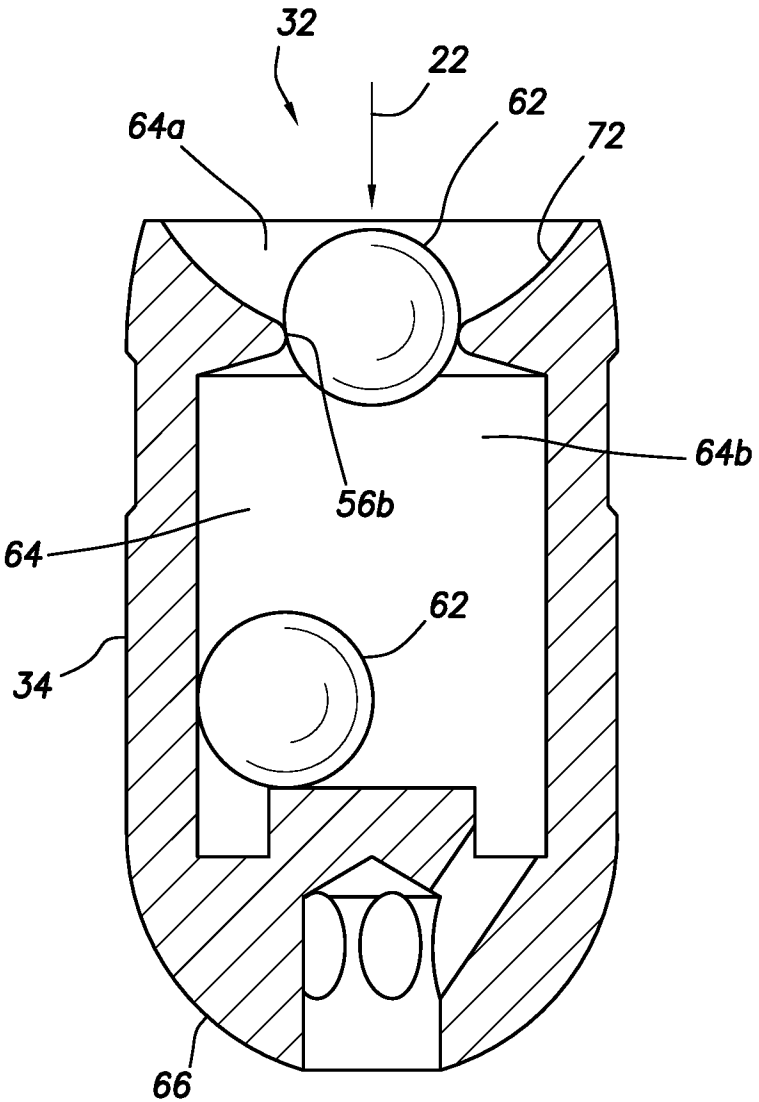

In the FIG. 4A example, a plug 62 can be deployed into the flow passage 64 after the jarring tool 32 has been deployed into the tubular string. Alternatively, the jarring tool 32 could be deployed into the tubular string together with the plug 62.

The plug 62 engages the plug seat 56*b* which, in this example, is formed in the outer housing 34. The plug 62 may sealingly engage the plug seat 56*b* to thereby isolate the upper flow passage section 64*a* from the lower flow passage section 64*b*. In other examples, some leakage of the fluid 22 past the plug 62 and plug seat 56*b* may be permitted after the plug engages the plug seat.

In either case, a pressure differential is created across the plug 62, since the plug prevents, blocks or obstructs the flow of the fluid 22 through the flow passage 64. When the pressure differential has increased to a predetermined level, or a sufficient amount of time has elapsed with a sufficient pressure differential across the plug 62, the plug will be discharged into the lower flow passage section 64*b*. This relieves the pressure differential across the plug 62 and produces the jarring force (e.g., due to conversion of potential energy to kinetic energy by release of the pressure built up in the upper flow passage section 64*a*).

In one example, the plug seat 56*b* can expand radially outward, in order to permit the plug 62 to be discharged into the lower flow passage section 64*b*. In this example, the plug seat 56*b* could comprise a resilient, elastomeric or otherwise deformable material.

In another example, the plug 62 can extrude through the seat 56*b*, in order to permit the plug to be discharged into the lower flow passage section 64*b*. In this example, the plug 62 could comprise a resilient, elastomeric or otherwise deformable material.

In yet another example, the plug 62 and/or the plug seat 56*b* could erode, in order to permit the plug to be discharged into the lower flow passage section 64*b*. The plug 62 and/or plug seat 56*b* could be configured to facilitate such erosion, as described more fully below.

After one plug 62 has been discharged into the lower flow passage section 64*b*, another plug 62 may be deployed into the flow passage 64, in order to obstruct the flow passage, and to create another pressure differential and subsequent release of the pressure differential to produce another jarring force. In the FIG. 4A example, a limited number of plugs 62 may be accommodated in the outer housing 34 below the plug seat 56*b*. In other examples, the plugs 62 could be discharged into the tubular string below the jarring tool 32, so that an unlimited number of jarring forces could be produced using a corresponding number of plugs.

In the FIG. 4B example, the plug 62 is in the form of an obstruction or piston that completely seals off the flow passage 64 between the upper and lower flow passage sections 64*a,b*. The piston or plug 62 is sealingly received in a bore 96 formed in the outer housing 34. The plug 62 is releasably secured in this position by shear pins 68 or other releasable members or structures (such as a shear ring, snap ring, latch, collets, etc.).

When a predetermined pressure differential is created across the plug 62, the shear pins 68 shear and permit the plug to be discharged into the lower flow passage section 64*b*. This relieves the pressure differential and produces the jarring force.

Figure 4D:
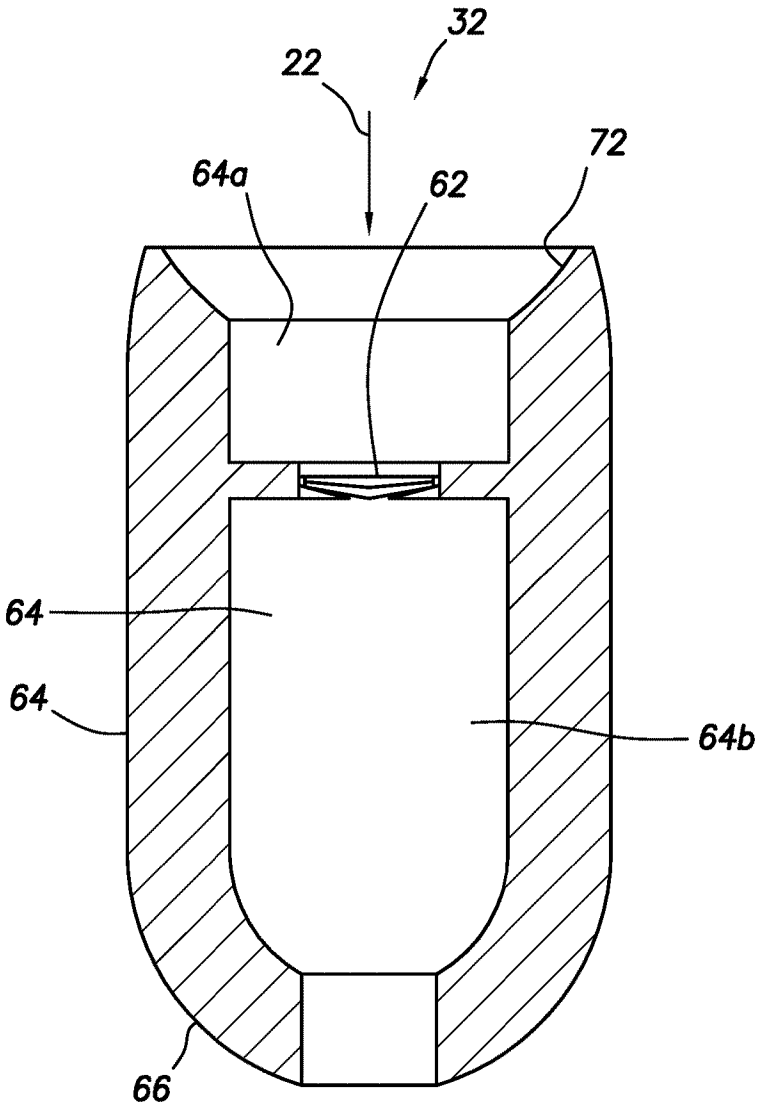
Figure 4C:
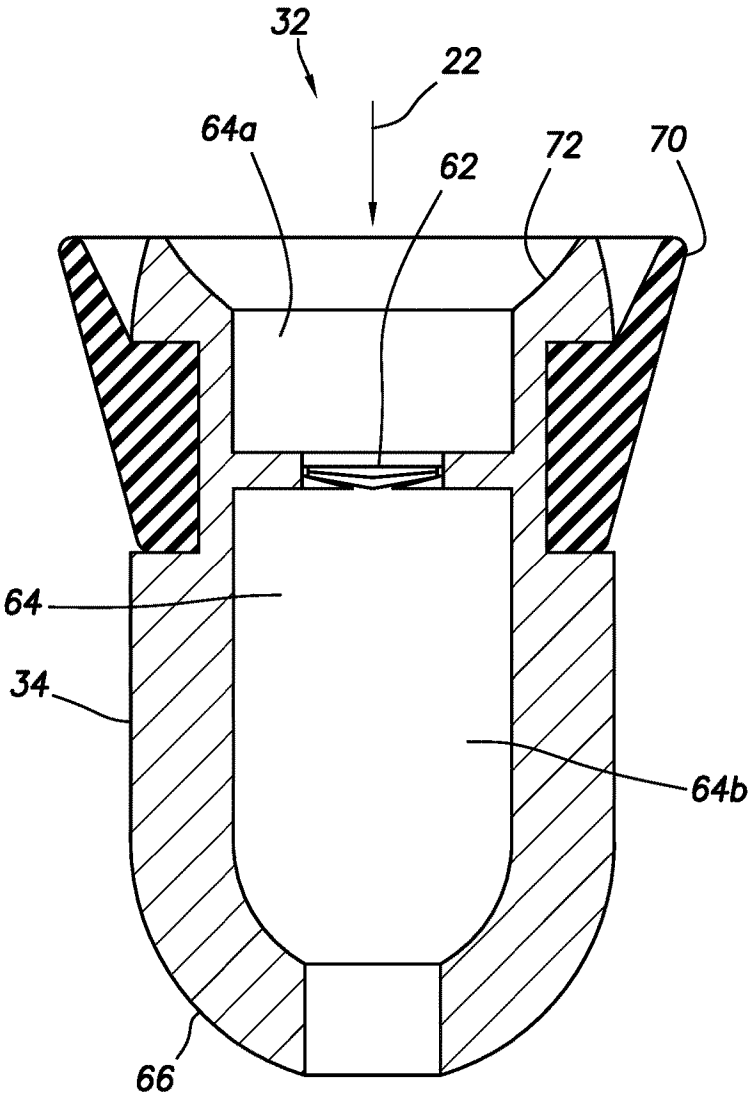

In the FIG. 4C example, the plug 62 comprises a rupture disk that completely seals off the flow passage 64 between the upper and lower flow passage sections 64*a,b*. When a predetermined pressure differential is created across the plug 62, the rupture disk ruptures. This relieves the pressure differential and produces the jarring force.

The FIG. 4C jarring tool 32 is also provided with an outer resilient seal, cup packer or wiper 70 carried on the outer housing 34. The wiper 70 can seal against an interior of the tubular string into which the jarring tool 32 is deployed. In some cases, the wiper 70 can enable the jarring tool 32 to be conveyed by the flow of the fluid 22 into long horizontal sections of the tubular string.

The wiper 70 or another external sealing or flow restricting component may be used on any of the other jarring tools 32 described herein that are deployed into a tubular string. If the wiper 70 is used on the jarring tool 32, the seal surface 66 may not be used.

In the FIG. 4D example, the plug 62 comprises a rupture disk, similar to the FIG. 4C example. However, the FIG. 4D example does not include the wiper 70 of the FIG. 4C example.

Note that each of the FIGS. 4A-D examples also includes a seal surface 72 formed on an upper end of the outer housing 34. The seal surface 72 enables another jarring tool 72 to be deployed into the tubular string and sealed against a previously deployed jarring tool. That is, a lower seal surface 66 on one jarring tool 32 can engage and seal against an upper seal surface 72 on another jarring tool. For this purpose, the upper seal surface 72 may be complementarily shaped relative to the upper seal surface 66 (e.g., curved, spherical, parabolic, frustoconical, etc.).

Figure 5:
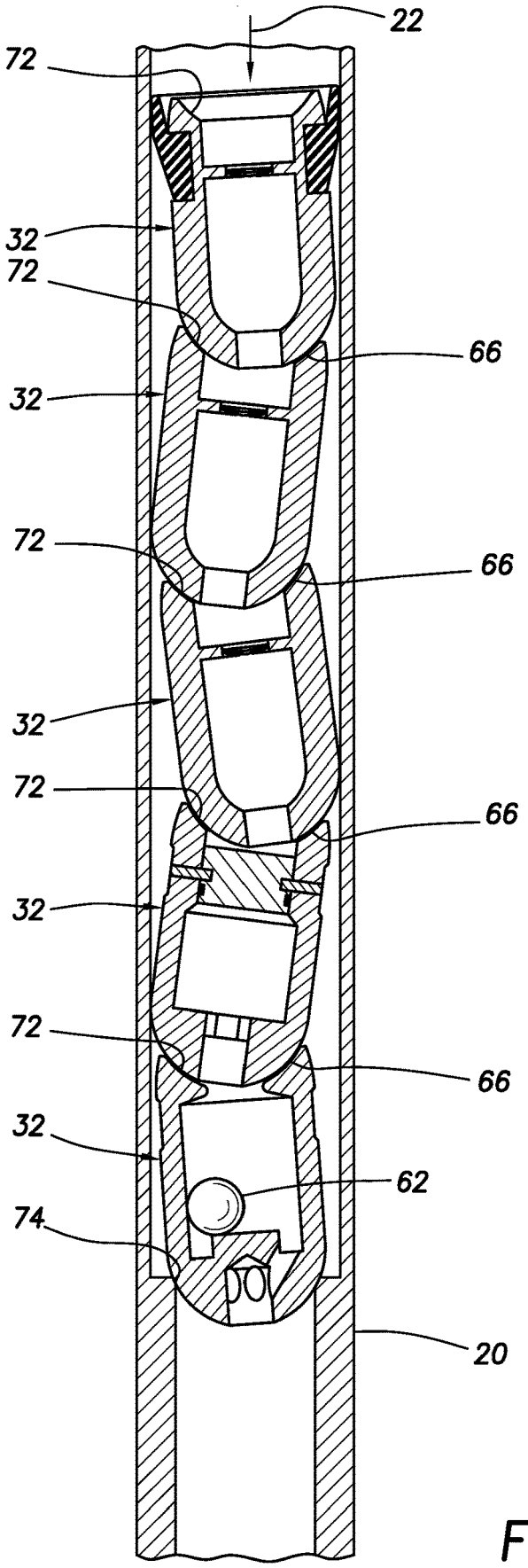
FIG. 5 is a representative cross-sectional view of the FIGS. 4A-D jarring tools deployed into a tubular string.

Referring additionally now to FIG. 5, an example of multiple jarring tools 32 deployed into the tubular string 20 is representatively illustrated. In this example, different ones of the FIGS. 4A-D jarring tools 32 have been deployed into the tubular string 20, but in other examples, multiple ones of the same jarring tool, or different combinations of jarring tools may be deployed into a tubular string.

In the FIG. 5 example, the FIG. 4A jarring tool 32 is initially deployed into the tubular string 20. The seal surface 66 on the jarring tool 32 sealingly engages a shoulder or other internal profile 74 in the tubular string 20. A pressure differential is created across at least one plug 62 in the jarring tool 32 to thereby produce a jarring force as described above.

When it is desired to produce another jarring force, the FIG. 4B jarring tool 32 is deployed into the tubular string 20. The lower seal surface 66 on the FIG. 4B jarring tool 32 sealingly engages the upper seal surface 72 on the FIG. 4A jarring tool 32. A pressure differential is created across the plug 62 in the FIG. 4B jarring tool 32 to thereby produce a jarring force as described above.

When it is desired to produce another jarring force, the FIG. 4D jarring tool 32 is deployed into the tubular string 20. The lower seal surface 66 on the FIG. 4D jarring tool 32 sealingly engages the upper seal surface 72 on the FIG. 4B jarring tool 32. A pressure differential is created across the plug 62 in the FIG. 4D jarring tool 32 to thereby produce a jarring force as described above.

When it is desired to produce another jarring force, another FIG. 4D jarring tool 32 is deployed into the tubular string 20. The lower seal surface 66 on the second FIG. 4D jarring tool 32 sealingly engages the upper seal surface 72 on the first FIG. 4D jarring tool 32. A pressure differential is created across the plug 62 in the second FIG. 4D jarring tool 32 to thereby produce a jarring force as described above.

When it is desired to produce another jarring force, the FIG. 4C jarring tool 32 is deployed into the tubular string 20. The lower seal surface 66 on the FIG. 4C jarring tool 32 sealingly engages the upper seal surface 72 on the second FIG. 4D jarring tool 32. A pressure differential is created across the plug 62 in the FIG. 4C jarring tool 32 to thereby produce a jarring force as described above.

It will be appreciated that additional jarring tools 32 can be deployed into the tubular string 20, in any order, to produce as many jarring forces as is desired. There may be no practical limit on the number of jarring tools 32 that can be deployed into the tubular string 20, other than an overall length of the jarring tools that can be accommodated in the tubular string.

Figure 6A:
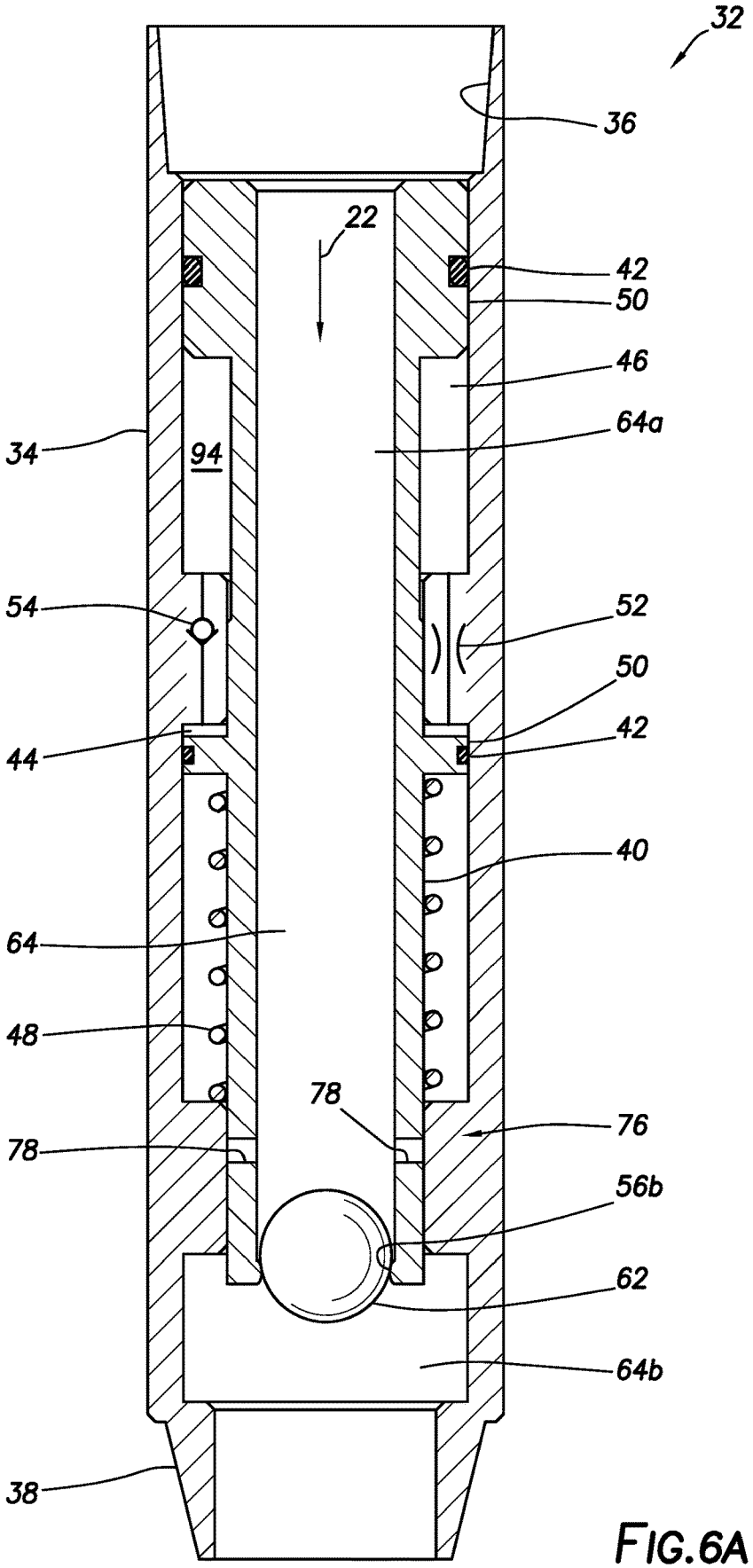
FIGS. 6A & B are representative cross-sectional views of another example of the jarring tool in unactivated and activated configurations.

Referring additionally now to FIGS. 6A & B, another example of the jarring tool 32 is representatively illustrated. In FIG. 6A the jarring tool 32 is depicted in an unactivated configuration, and in FIG. 6B the jarring tool is depicted in an activated configuration. In the FIGS. 6A & B example, the connectors 36, 38 are provided to enable the jarring tool 32 to be connected in a bottom hole assembly or tubular string, but in other examples, the jarring tool could be separately deployed into a tubular string.

Instead of a single piston 50, the FIGS. 6A & B example includes two pistons, with the chambers 44, 46 disposed between the pistons. The chambers 44, 46 are separated by a radially reduced portion of the outer housing 34, with the mandrel 40 being closely slidingly received in the radially reduced portion. The flow controllers 52, 54 are disposed in the radially reduced portion of the outer housing 32.

As depicted in FIG. 6A, the plug 62 has been deployed into the flow passage 64, so that it engages the plug seat 56*b* formed at a lower end of the mandrel 40. In this example, the collets 56 are not used, and the plug seat 56*b* is not radially expandable, but collets and/or an expandable plug seat could be used if desired.

A valve 76 is formed at the lower end of the mandrel 40 in cooperation with the outer housing 34. The valve 76 includes a port 78 formed through a wall of the mandrel 40. The lower end of the mandrel 40 is closely received in the outer housing 34, so that only minimal leakage of the fluid 22 through the port 78 is permitted in the FIG. 6A unactivated configuration.

After the plug 62 is deployed into the flow passage 64 and engaged with the plug seat 56*b*, a pressure differential can be created across the plug. The pressure differential biases the mandrel 40 and pistons 50 downward against the upward biasing force exerted by the spring 48. As the mandrel 40 and pistons 50 displace downward, the flow controller 52 controls the flow of fluid 94 from the chamber 44 to the chamber 46, similar to the manner described above for the FIGS. 2A-3B examples.

Figure 6B:
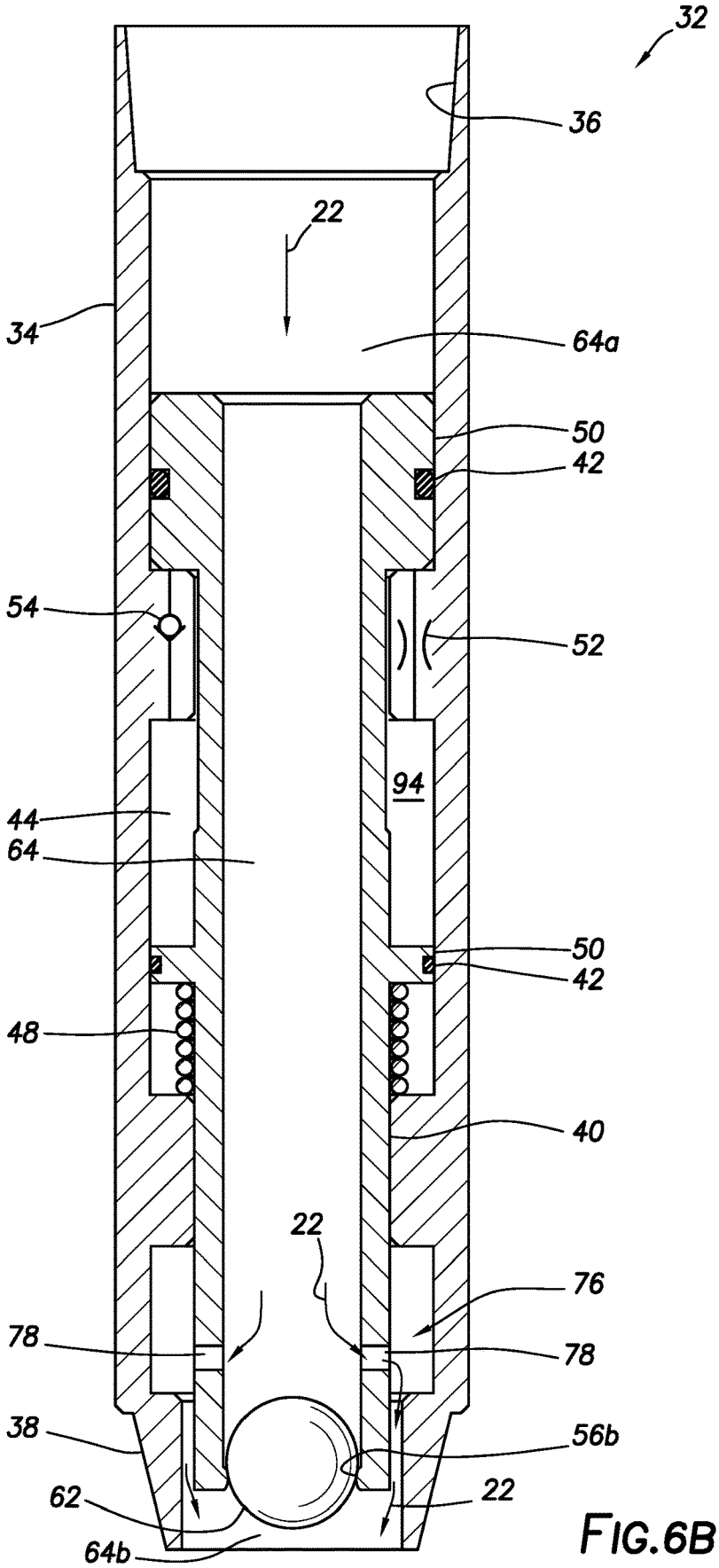

As depicted in FIG. 6B, the mandrel 40 and pistons 50 have displaced downward to their activated positions. The port 78 in the mandrel 40 is no longer effectively blocked by the outer housing 34, so that the valve 76 is opened and the fluid 22 is permitted to bypass the plug 62 and flow into the lower flow passage section 64*b*. This relieves the pressure differential across the plug 62 and thereby produces the jarring force.

Once the pressure differential is sufficiently relieved, the spring 48 can displace the mandrel 40 and pistons 50 upward to the FIG. 6A unactivated position, thereby closing the valve 76. Another jarring force can be produced by again applying a pressure differential across the plug 62.

The plug 62 can comprise a material that eventually dissolves, melts, erodes, degrades, extrudes through the plug seat 56*b* or otherwise no longer blocks or obstructs the flow passage 64. This would enable continued drilling or other operations to be performed after the jarring forces have been applied as desired.

Figure 7A:
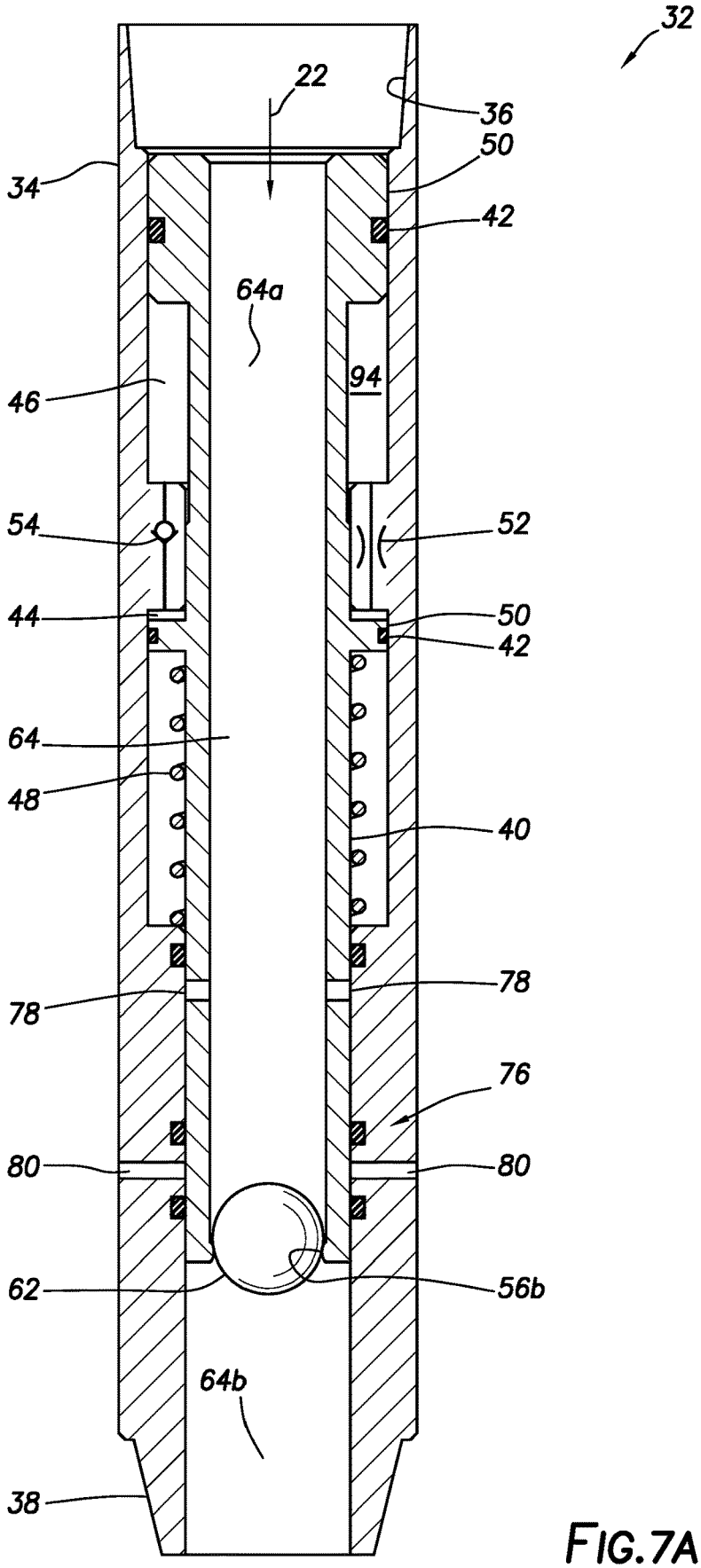
FIGS. 7A & B are representative cross-sectional views of another example of the jarring tool in unactivated and activated configurations.

Referring additionally now to FIGS. 7A & B, another example of the jarring tool 32 is representatively illustrated in respective unactivated and activated configurations. In the FIGS. 7A & B example, the connectors 36, 38 are provided to enable the jarring tool 32 to be connected in a bottom hole assembly or tubular string, but in other examples, the jarring tool could be separately deployed into a tubular string.

The FIGS. 7A & B example is similar in many respects to the FIGS. 6A & B example and operates in a similar manner. However, the valve 76 of the FIGS. 7A & B example is significantly different from the valve of the FIGS. 6A & B example. More specifically, the valve 76 in the FIGS. 6A & B example selectively permits and prevents (or at least substantially restricts) flow between the upper and lower flow passage sections 64*a,b*, whereas the valve 76 in the FIGS. 7A & B example selectively permits and prevents flow between the upper flow passage section 64*a* and an exterior of the jarring tool 32.

In the FIG. 1 system, the exterior of the jarring tool 32 corresponds to the annulus 26 between the drill string 12 and the wellbore 14. In other examples, the exterior of the jarring tool 32 could correspond to an annular space between two tubular strings, or to another fluid volume in the well.

Figure 7B:
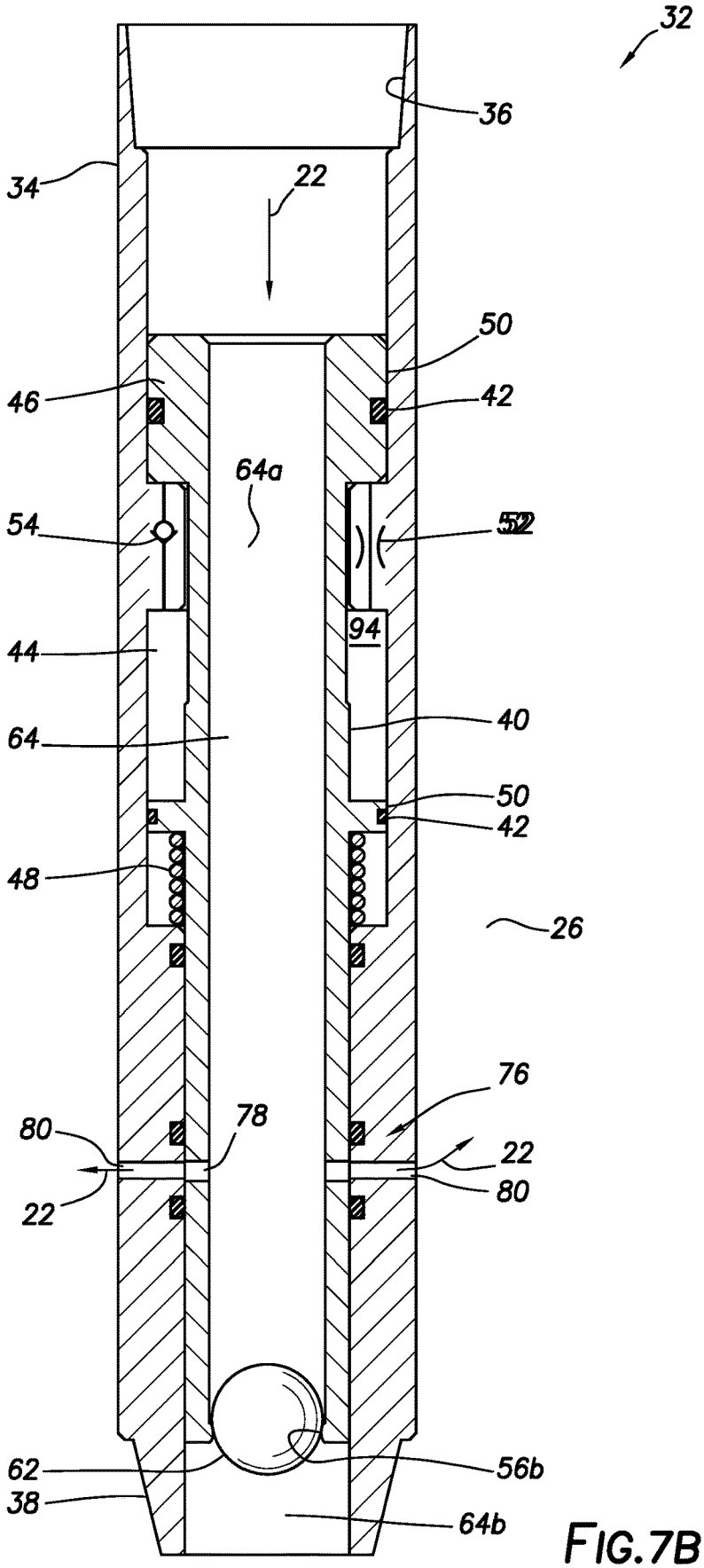

The valve 76 in the FIG. 7B example includes the ports 78 in the mandrel 40 and additional ports 80 formed through a wall of the outer housing 34. In the FIG. 7A unactivated configuration of the jarring tool 32, the ports 78, 80 are not aligned and fluid communication between the upper flow passage section 64*a* and the exterior of the jarring tool is prevented. In the FIG. 7B activated configuration of the jarring tool 32, the ports 78, 80 are aligned and fluid communication between the upper flow passage section 64*a* and the exterior of the jarring tool is permitted.

When fluid communication between the upper flow passage section 64*a* and the exterior of the jarring tool 32 is permitted, the pressure differential across the plug 62 is relieved and the jarring force is thereby produced. Once the pressure differential is sufficiently relieved, the spring 48 can displace the mandrel 40 and pistons 50 upward to the FIG. 7A unactivated position, thereby closing the valve 76. Another jarring force can be produced by again applying a pressure differential across the plug 62.

As with the other examples described herein, the plug 62 can comprise a material that eventually dissolves, melts, erodes, degrades, extrudes through the plug seat 56*b* or otherwise no longer blocks or obstructs the flow passage 64. This would enable continued drilling or other operations to be performed after the jarring forces have been applied as desired.

Figure 8A:
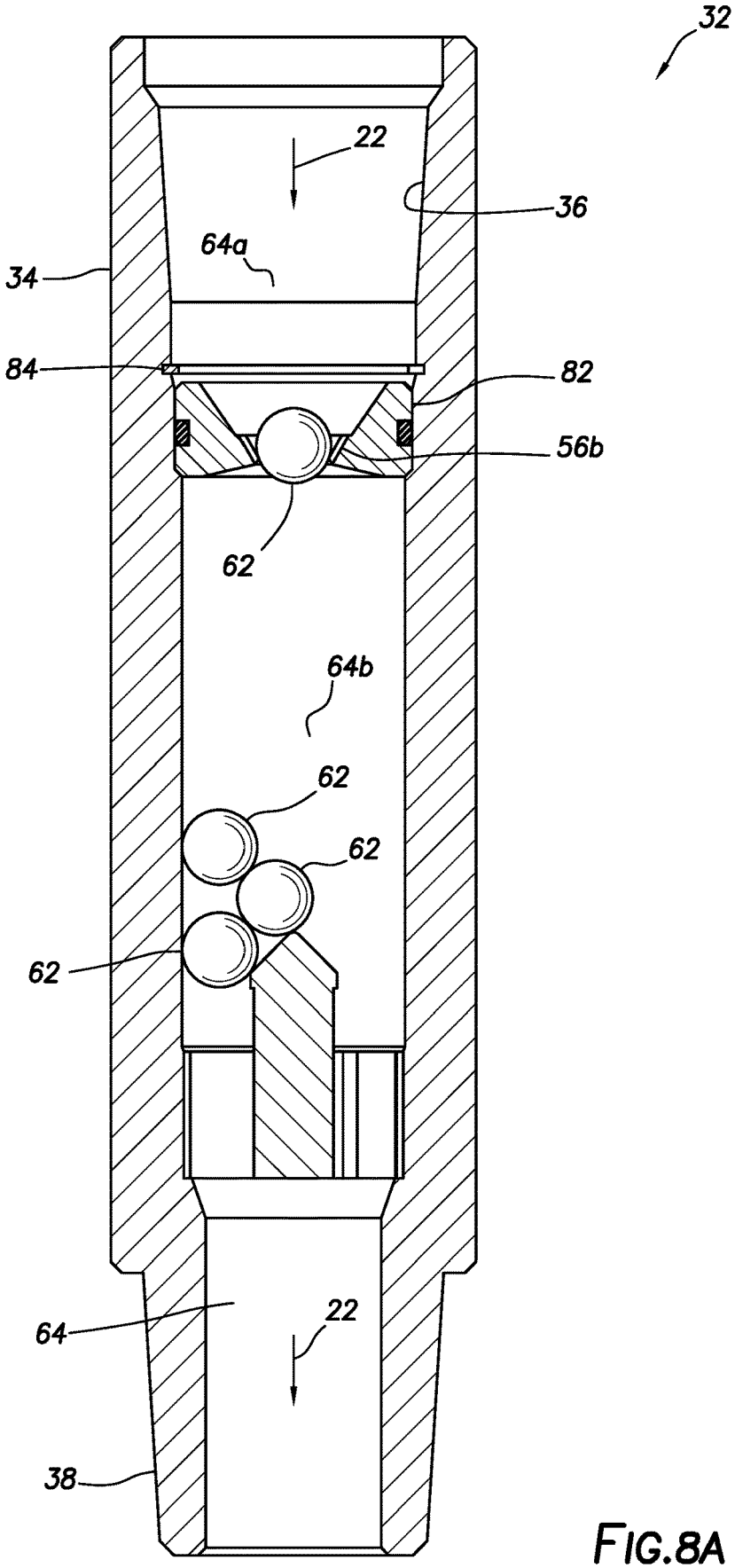
FIGS. 8A & B are representative cross-sectional views of another example of the jarring tool.

Referring additionally now to FIGS. 8A & B, another example of the jarring tool 32 is representatively illustrated. In the FIGS. 8A & B example, the connectors 36, 38 are provided to enable the jarring tool 32 to be connected in a bottom hole assembly or tubular string, but in other examples, the jarring tool could be separately deployed into a tubular string.

The FIGS. 8A & B example is similar in many respects to the FIG. 4A example and operates in a similar manner. However, in the FIGS. 8A & B example, the plug seat 56*b* is formed in a separate annular seat 82 that is releasably secured in the outer housing 34 (for example, using a snap ring 84).

Figure 8B:
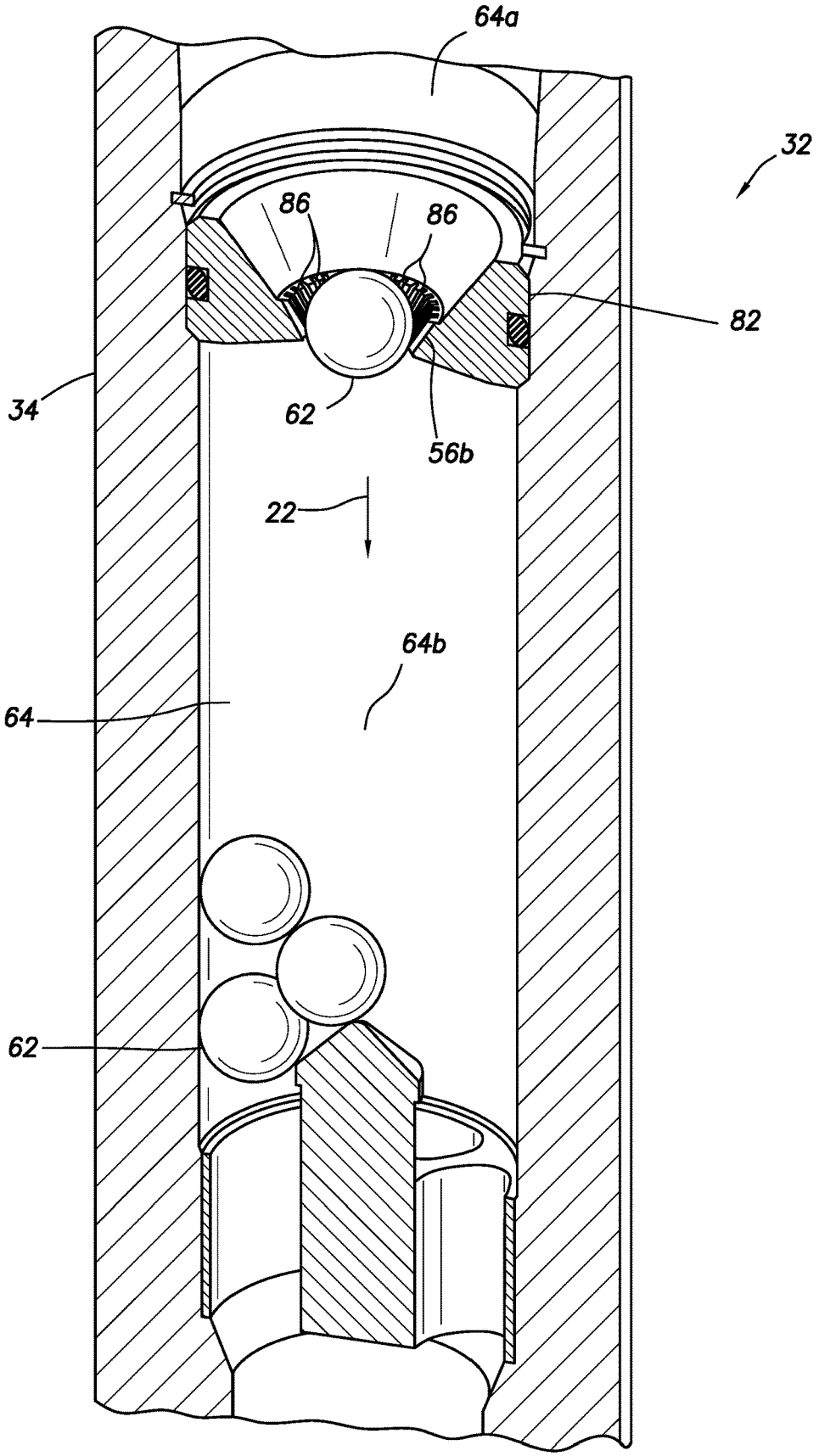

In FIG. 8B it can be more clearly seen that the plug seat 56*b* has a series of circumferentially distributed and longitudinally extending channels 86 formed therein. The channels 86 permit the fluid 22 to flow around the plug 62 when the plug is engaged with the plug seat 56*b*.

Although the channels 86 do permit some flow of the fluid 22 around the plug 62, a pressure differential can still be created across the plug, since the flow of the fluid is substantially restricted by the plug, which blocks or obstructs a substantial majority of a flow area through the plug seat 56*b*.

Because the flow of the fluid 22 is substantially blocked or obstructed by the plug 62, the fluid which does flow through the channels 86 flows at an increased flow velocity. This increased flow velocity causes erosion of the plug 62.

Eventually, the plug 62 erodes sufficiently to allow the plug to pass through the plug seat 56*b* and into the lower flow passage section 64*b*. This relieves the pressure differential across the plug 62, thereby producing the jarring force. One or more additional plugs 62 may be deployed into the flow passage 64 if it is desired to produce respective additional jarring forces.

Instead of the channels 86, other elements or structures could be provided to permit some flow of the fluid 22 about the plug 62 when it is engaged with the plug seat 56*b*. For example, a wire mesh or cloth could be provided on the plug seat 56*b* to prevent complete sealing of the plug 62 against the plug seat.

Figure 9:
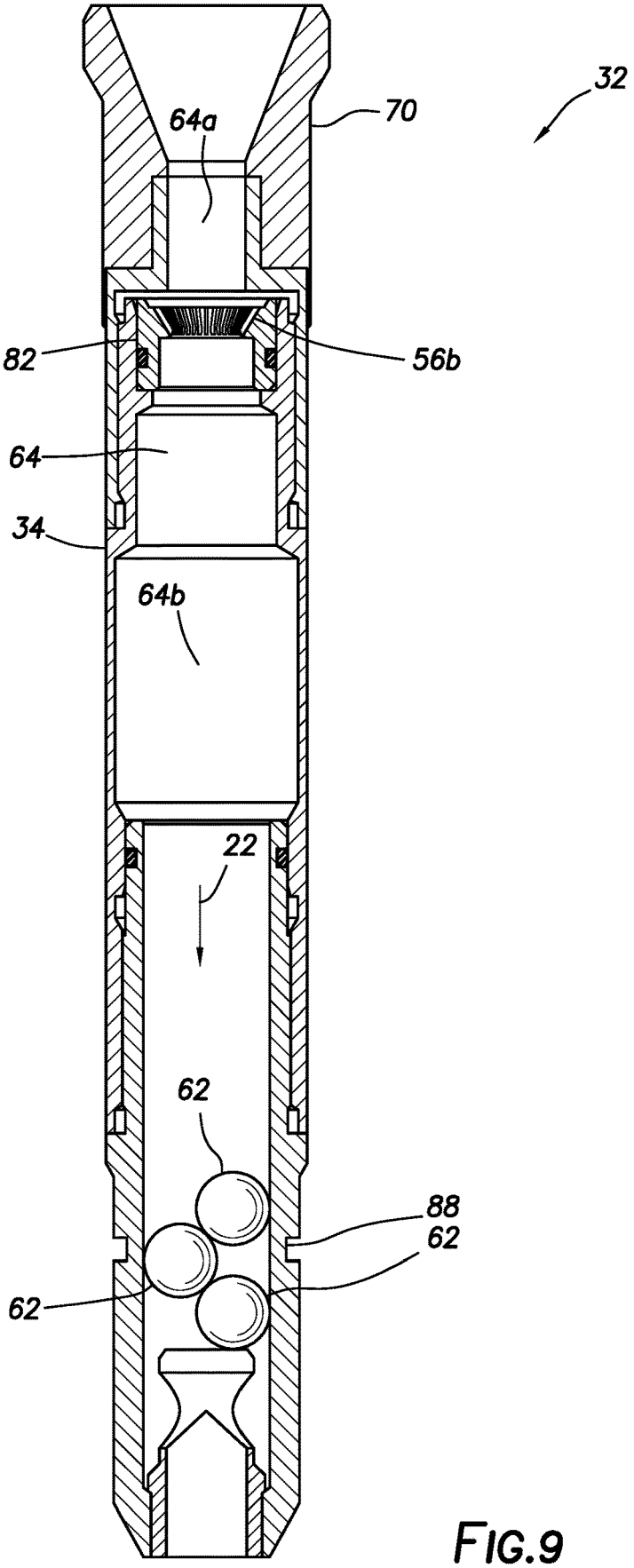
FIG. 9 is a representative cross-sectional view of another example of the jarring tool.

Referring additionally now to FIG. 9, another example of the jarring tool 32 is representatively illustrated. In this example, the jarring tool 32 is configured to be separately deployed into a tubular string.

The FIG. 9 example is similar in many respects to the FIGS. 8A & B example and operates in a substantially similar manner. However, the FIG. 9 example is provided with a wiper 70, cup packer or other sealing device to sealingly engage an interior of the tubular string into which it is deployed, similar to the wiper in the FIG. 4C example. Alternatively, or in addition, a seal (such as an o-ring or a chevron seal) could be disposed in an annular recess 88 formed on an exterior of the outer housing 34 for sealing engagement with an internal bore of the tubular string.

In a similar manner, any of the jarring tool 32 examples described herein as being configured for connection in a tubular string or bottom hole assembly can be readily configured for separate deployment into a tubular string. For example, the jarring tools 32 can be appropriately dimensioned to fit within the interior of a tubular string and can be provided with a wiper, seal or other sealing device appropriate to sealingly engage an interior of the tubular string (such as, at a shoulder, profile or bore in the tubular string).

The plug seat 56*b* of the FIGS. 8A-9 examples having the channels 86 formed thereon may be used for the plug seat in any of the other jarring tool 32 examples described herein.

Figure 10:
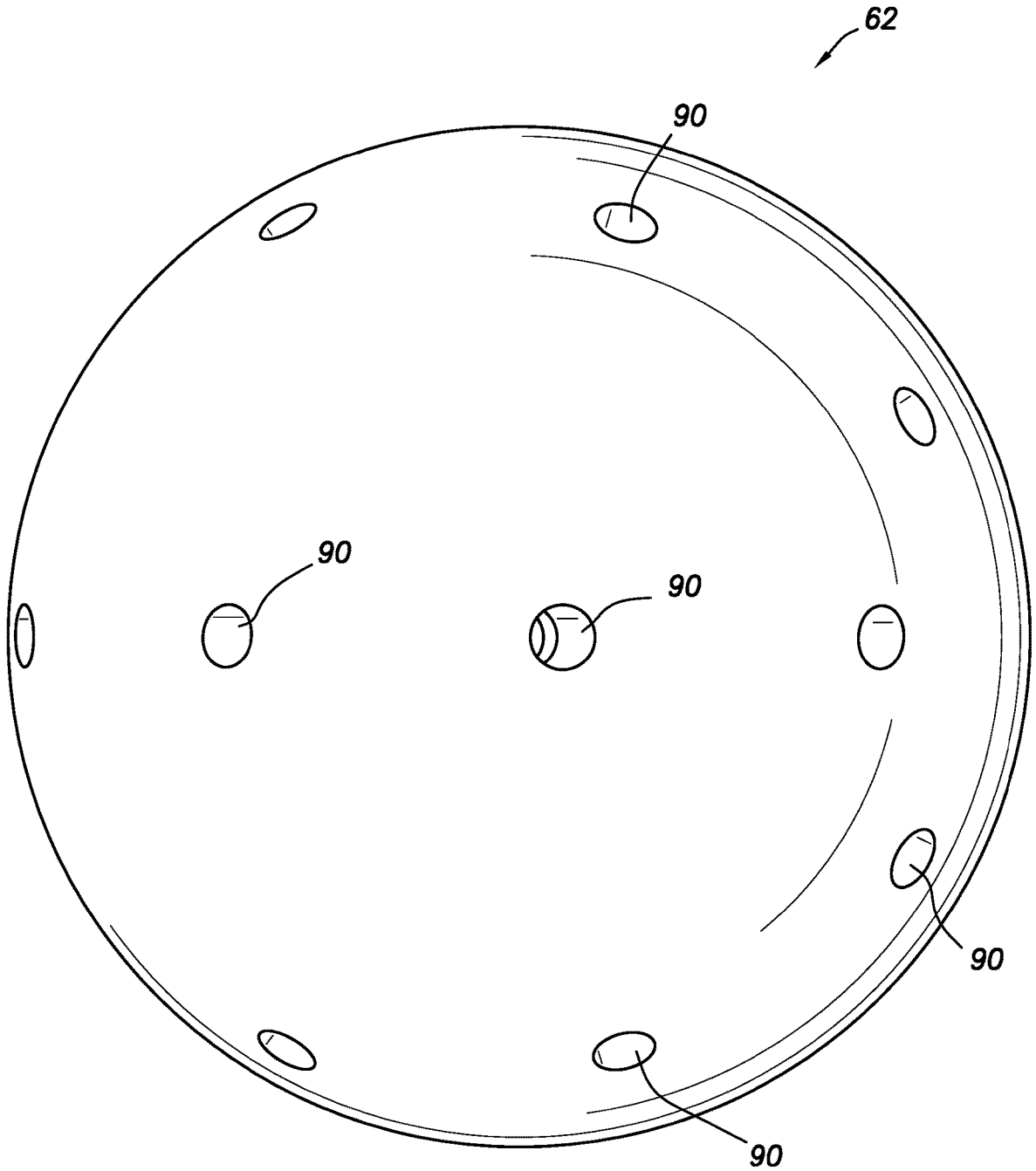
FIGS. 10 & 11 are representative side views of an erodible plug that may be used in the jarring tool.
Figure 11:
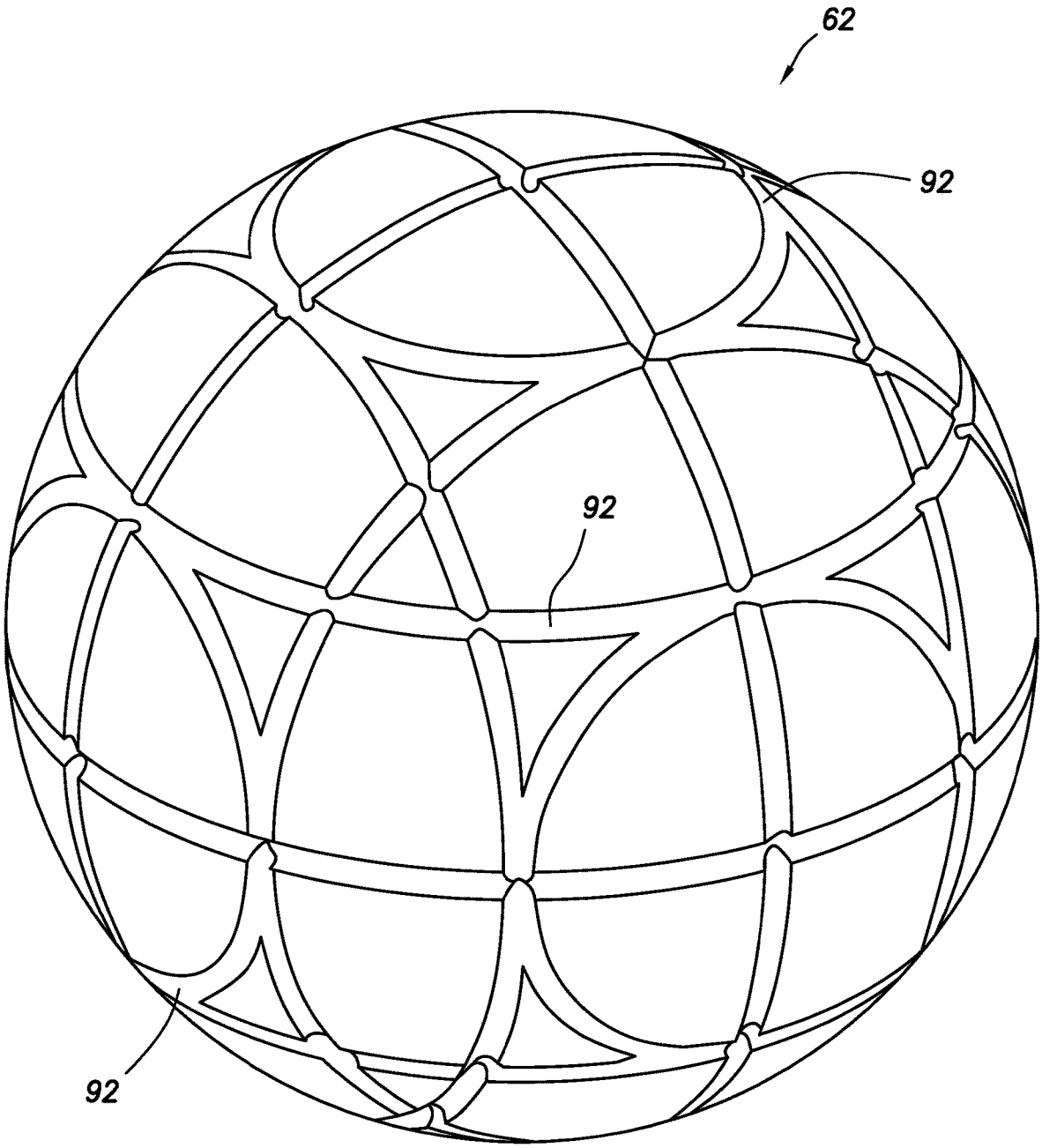

Referring additionally now to FIGS. 10 & 11, additional examples of the plug 62 are representatively illustrated. The FIGS. 10 & 11 examples may be used with any of the jarring tool 32 examples described herein.

The plugs 62 of FIGS. 10 & 11 are specially configured to facilitate erosion of the plugs when a pressure differential is created across the plugs. The FIGS. 10 & 11 plugs 62 may be used with the plug seat 56*b* in the FIGS. 2A-7B examples, and they may also be used with the FIGS. 8A-9 plug seats 56*b* (with the channels 86 therein) if desired.

In the FIG. 10 plug 62 example, the plug is hollow and multiple small openings 90 are formed through a wall of the plug. The openings 90 prevent the plug 62 from completely sealing off the flow area through the plug seat 56*b*. Instead, the plug 62 blocks or obstructs the flow through the plug seat 56*b*, but does not completely prevent fluid communication between the upper and lower flow passage sections 64*a,b*.

The openings 90 permit the fluid 22 to flow through the plug 62 when the plug is engaged with the plug seat 56*b*. Although the openings 90 do permit some flow of the fluid 22 through the plug 62, a pressure differential can still be created across the plug, since the flow of the fluid is substantially restricted by the plug.

Because the flow of the fluid 22 is substantially blocked or obstructed by the plug 62, the fluid which does flow through the openings 90 flows at an increased flow velocity. This increased flow velocity causes erosion of the plug 62.

Eventually, the plug 62 erodes sufficiently to allow the plug to pass through the plug seat 56*b* and into the lower flow passage section 64*b*. This relieves the pressure differential across the plug 62, thereby producing the jarring force. One or more additional plugs 62 may be deployed into the flow passage 64 if it is desired to produce respective additional jarring forces.

In the FIG. 11 plug 62 example, the plug is solid, but it has multiple channels 92 formed on its exterior surface. The channels 92 prevent the plug 62 from completely sealing off the flow area through the plug seat 56*b*. Instead, the plug 62 blocks or obstructs the flow through the plug seat 56*b*, but does not completely prevent fluid communication between the upper and lower flow passage sections 64*a,b*.

The channels 92 permit the fluid 22 to flow around the plug 62 when the plug is engaged with the plug seat 56*b*. Although the channels 92 do permit some flow of the fluid 22 around the plug 62, a pressure differential can still be created across the plug, since the flow of the fluid is substantially restricted by the plug.

Because the flow of the fluid 22 is substantially blocked or obstructed by the plug 62, the fluid which does flow through the channels 92 flows at an increased flow velocity. This increased flow velocity causes erosion of the plug 62.

Eventually, the plug 62 erodes sufficiently to allow the plug to pass through the plug seat 56*b* and into the lower flow passage section 64*b*. This relieves the pressure differential across the plug 62, thereby producing the jarring force. One or more additional plugs 62 may be deployed into the flow passage 64 if it is desired to produce respective additional jarring forces.

Preferably, the FIG. 10 or FIG. 11 plug 62 erodes at a sufficiently slow rate that a desired pressure differential across the plug can be achieved and maintained prior to the plug being discharged through the seat 56*b*. In this manner, a desired jarring force will be produced when the pressure differential across the plug 62 is relieved. The applied pressure differential, the configurations and dimensions of the plug 62 and seat 56*b*, and the material of the plug can be varied, empirically tested and selected to produce a desired erosion rate.

The erodible ball, dart or other plug 62 may be made from metal or plastic in some examples. Dissolvable metal or plastic may be used to speed up the process or to remove plugs after use. Fibrous or particulate filler materials can be added to dissolvable or erodible plastic to alter the mechanical properties of the ball, dart or other plug.

Materials for the erodible plug can include: water-soluble polymers (such as, polyvinyl acetate, polyvinyl alcohol, partially hydrolyzed polyvinyl acetate, polyethylene glycol, polyvinyl pyrrolidone, cellulose ethers), and water-degradable polymers (polylactic acid, polyglycolic acid, poly(3-hydroxybutyrate), poly(3-hydroxyvalerate), and copolymers thereof).

Polymers can be used alone, or in combination with other materials to control the mechanical properties and erosion rates. The water-soluble polymer or water-degradable polymer can be used as a binder with an insoluble filler. Alternatively, water soluble filler (e.g., salt) can be used in combination with the water-soluble or degradable polymer.

In some applications, water-soluble filler (e.g., water-soluble polymer, salt, etc.) can be used in combination with a non-water-soluble polymer, such as polystyrene, polyethylene, or epoxy resin. Erodible plugs can also be made from mixtures of water-soluble material and an inorganic binder, such as a mixture of granular salt and a binder (e.g., magnesium oxychloride).

Use of an erodible plug 62 in the jarring tool 32 examples described above can have certain advantages, including but not limited to: maximum allowable tubing pressure can be applied to the plug because variability of the plug release is eliminated (that is, the plug will eventually erode, as long as a pressure differential is applied across the plug, so there is no need to apply any particular pressure to the tubular string at the surface to cause the erosion), any danger of the plug requiring more pressure than anticipated is eliminated, the same plug design can be used for all allowable tubing pressure ranges, the same plug design can be used for all temperature ranges, the pump-through pressure of the plug is variable and is determined by the pump operator, and the plug can be used to seat on multiple seats of decreasing size.

Although in the above described examples, the jarring tool 32 may be used to free a tubular string or other equipment stuck in a well, the scope of this disclosure is not limited to only this application. Other possible uses of the jarring tool 32 include actuation or operation of a variety of different well tools, such as sliding sleeve valves, perforating equipment, or any other equipment that may be operated using a jarring force or impact.

It may now be fully appreciated that the above disclosure provides significant advancements to the art of constructing and utilizing jarring tools for use in subterranean wells. In examples described above, a jarring force can be produced conveniently multiple times in a single trip into a well, and in some examples without interfering substantially with ongoing well operations.

The above disclosure provides to the art a jarring tool 32 for use in a subterranean well. In one example, the jarring tool 32 can comprise: a piston 50 longitudinally displaceable from a first position to a second position, a first fluid chamber 46 having a volume that decreases in response to displacement of the piston 50 from the first position to the second position, a first flow controller 52 that controls flow of fluid 94 between the first fluid chamber 46 and a second fluid chamber 44, and a plug seat 56*b* secured to the piston 50. In some examples described above, the plug seat 56*b* is secured to the piston 50 by being integrally formed with the piston.

The first flow controller 52 may comprise a flow restrictor. The second fluid chamber 44 may have a volume that increases in response to displacement of the piston 50 from the first position to the second position.

Expansion of the plug seat 56*b* may be prevented when the piston 50 is in the first position, and expansion of the plug seat 56*b* may be permitted when the piston 50 is in the second position.

The plug seat 56*b* may be integrally formed with the piston 50. The plug seat 56*b* may be formed in a tubular mandrel 40 extending longitudinally from the piston 50. The plug seat 56*b* may comprise multiple collets 56 formed on a tubular mandrel 40 secured to the piston 50.

The jarring tool 32 may include a second flow controller 54 that prevents flow of the fluid 94 from the first fluid chamber 46 to the second fluid chamber 44, and permits flow of the fluid 94 from the second fluid chamber 44 to the first fluid chamber 46.

The jarring tool 32 may include a spring 48 that biases the piston 50 toward the first position. A valve 76 may open in response to displacement of the piston 50 from the first position to the second position.

A flow passage 64 may extend longitudinally through the jarring tool 32, and the plug seat 56*b* may be positioned between first and second sections 64*a,b* of the flow passage 64. The valve 76 may selectively control fluid communication with the first flow passage section 64*a*, between the first and second flow passage sections 64*a,b*, and/or between the first flow passage section 64*a* and an exterior of the jarring tool 32.

The above disclosure also provides to the art a method of applying a jarring force to equipment (such as the bottom hole assembly 18 or the tubular string 20) stuck in a subterranean well. In one example, the method can comprise: applying a pressure differential across a plug 62 in a jarring tool 32, the plug 62 restricting flow from a first flow passage section 64*a* to a second flow passage section 64*b*; then increasing a flow rate of fluid 22 from the first flow passage section 64*a*; and the increased flow rate of the fluid 22 thereby applying the jarring force to the stuck equipment.

The flow rate increasing step may comprise discharging the plug 62 from the jarring tool 32, releasing the plug 62 from engagement with a plug seat 56*b* of the jarring tool 32, eroding the plug 62 in response to flow of the fluid 22 past the plug 62, and/or expanding a plug seat 56*b* of the jarring tool 32, thereby permitting the plug 62 to displace through the plug seat 56*b*.

The pressure differential applying step may comprise displacing a piston 50 of the jarring tool 32 from a first position to a second position. The method may include displacing the piston 50 from the second position to the first position after the flow rate increasing. The method may include expanding a plug seat 56*b* in response to the piston 50 displacing.

The method may include, after the equipment is stuck in the well, deploying the jarring tool 32 into a tubular string 20 in the well. The method may include engaging the jarring tool 32 with another jarring tool 32 previously deployed into the tubular string 20.

The flow rate increasing step may include the pressure differential forcing the plug 62 to displace through a plug seat 56*b* of the jarring tool 32. The plug 62 may comprise a piston, and the flow rate increasing step may include the pressure differential displacing the piston from a bore 96 of the jarring tool 32.

The flow rate increasing step may include permitting flow through a port 78 of the jarring tool 32. The port 78 may be formed through a wall of a mandrel 40 of the jarring tool 32, a plug seat 56*b* may be formed in the mandrel 40, and the mandrel 40 may displace from a first position to a second position in response to the pressure differential applying step, flow through the port 78 being permitted when the mandrel 40 displaces to the second position.

The flow rate increasing step may comprise eroding the plug 62. The eroding step may include permitting the fluid 22 to flow between the plug 62 and a plug seat 56*b* of the jarring tool 32.

The flow rate increasing step may comprise opening a valve 76. Opening the valve 76 may comprise controlling fluid communication with the first flow passage section 64*a*, controlling fluid communication between the first and second flow passage sections 64*a,b*, and/or permitting fluid communication between the first flow passage section 64*a* and an exterior of the jarring tool 32.

The flow rate increasing step may comprise increasing the flow rate from the first flow passage section 64*a* to the second flow passage section 64*b*.

The above disclosure provides to the art another jarring tool 32 for use in a subterranean well. In this example, the jarring tool 32 comprises an outer housing 34 including a flow passage 64 extending longitudinally through the outer housing 34, first and second opposite ends of the outer housing 34, a first seal surface 66 at the first opposite end, and a second seal surface 72 at the second opposite end. A flow obstruction (such as the plug 62) blocks fluid flow through the flow passage 64. The fluid flow through the flow passage 64 is increased in response to application of a pressure differential across the obstruction 62.

The flow obstruction may comprise a plug 62, and the outer housing 34 may comprise a plug seat 56*b*. The pressure differential may force the plug 62 through the plug seat 56*b*. The pressure differential may cause erosion of the plug 62.

The first seal surface 66 may comprise a curved surface. The curved surface may comprise a spherical surface.

The flow obstruction 62 may comprise a piston sealingly received in a bore 96 formed in the outer housing 34. The pressure differential may cause the piston to be discharged from the bore 96.

The flow obstruction 62 may comprise a rupture disk or a pressure relief valve. The second seal surface 72 may be configured to sealingly engage another jarring tool 32.

Another method of jarring equipment stuck in a subterranean well is described above. In this example, the method comprises: deploying a first jarring tool 32 into a tubular string 20; applying a first pressure differential across the first jarring tool 32, thereby applying a first jarring force to the equipment; deploying a second jarring tool 32 into the tubular string 20; contacting the second jarring tool 32 with the first jarring tool 32; and applying a second pressure differential across the second jarring tool 32, thereby applying a second jarring force to the equipment.

The contacting step may comprise sealingly engaging the second jarring tool 32 with the first jarring tool 32. The sealingly engaging step may include engaging a first curved seal surface 66 on the first jarring tool 32 with a second curved seal surface 72 on the second jarring tool 32. The first jarring tool 32 deploying step may be performed after the equipment is stuck in the well.

The first pressure differential applying step may comprise applying the first pressure differential across an obstruction 62 that blocks fluid flow through a flow passage 64 extending longitudinally through an outer housing 34 of the first jarring tool 32. The flow obstruction may comprise a plug 62, the outer housing 34 may comprise a plug seat 56*b*, and the first pressure differential may force the plug 62 through the plug seat 56*b*. The first pressure differential may cause erosion of the plug 62.

The flow obstruction 62 may comprise a piston sealingly received in a bore 96 formed in the outer housing 34. The first pressure differential may cause the piston to be discharged from the bore 96.

The flow obstruction 62 may comprise a rupture disk. The first pressure differential may rupture the rupture disk.

The flow obstruction 62 may comprise a pressure relief valve. The first pressure differential may open the pressure relief valve.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A jarring tool for use in a subterranean well, the jarring tool comprising:

a piston longitudinally displaceable from a first position to a second position;

a first fluid chamber having a volume that decreases in response to displacement of the piston from the first position to the second position;

a first flow controller that controls flow of fluid between the first fluid chamber and a second fluid chamber; and a plug seat secured to the piston, in which the plug seat is configured to receive a plug which is introduced into the jarring tool when activation of the jarring tool is desired.

2. The jarring tool of claim 1, in which the first flow controller comprises a flow restrictor.

3. The jarring tool of claim 1, in which the second fluid chamber has a volume that increases in response to displacement of the piston from the first position to the second position.

4. The jarring tool of claim 1, in which expansion of the plug seat is prevented when the piston is in the first position, and expansion of the plug seat is permitted when the piston is in the second position.

5. The jarring tool of claim 1, in which the plug seat is integrally formed with the piston.

6. The jarring tool of claim 5, in which the plug seat is formed in a tubular mandrel extending longitudinally from the piston.

7. The jarring tool of claim 1, in which the plug seat comprises multiple collets formed on a tubular mandrel secured to the piston.

8. The jarring tool of claim 1, further comprising a second flow controller that prevents flow of the fluid from the first fluid chamber to the second fluid chamber and permits flow of the fluid from the second fluid chamber to the first fluid chamber.

9. The jarring tool of claim 1, further comprising a spring that biases the piston toward the first position.

10. The jarring tool of claim 1, in which a valve opens in response to displacement of the piston from the first position to the second position.

11. The jarring tool of claim 10, in which a flow passage extends longitudinally through the jarring tool, the plug seat is positioned between first and second sections of the flow passage, and the valve selectively permits fluid communication with the first flow passage section.

12. The jarring tool of claim 11, in which the valve selectively controls fluid communication between the first and second flow passage sections.

13. The jarring tool of claim 11, in which the valve selectively controls fluid communication between the first flow passage section and an exterior of the jarring tool.

14. A method of applying a jarring force to equipment stuck in a subterranean well, the method comprising:

introducing a plug into a jarring tool when activation of the jarring tool is desired;

engaging the plug with a plug seat of the jarring tool;

applying a pressure differential across the plug in a jarring tool, the plug restricting flow from a first flow passage section to a second flow passage section;

building pressure within the jarring tool by controlling a rate of displacement of a piston of the jarring tool;

then increasing a flow rate of fluid from the first flow passage section; and the increased flow rate of the fluid thereby applying the jarring force to the stuck equipment.

15. The method of claim 14, in which the flow rate increasing comprises discharging the plug from the jarring tool.

16. The method of claim 14, in which the flow rate increasing comprises releasing the plug from engagement with the plug seat of the jarring tool.

17. The method of claim 14, in which the flow rate increasing comprises eroding the plug in response to flow of the fluid past the plug.

18. The method of claim 14, in which the flow rate increasing comprises expanding the plug seat of the jarring tool, thereby permitting the plug to displace through the plug seat.

19. The method of claim 14, in which the pressure differential applying comprises displacing the piston of the jarring tool from a first position to a second position.

20. The method of claim 19, further comprising displacing the piston from the second position to the first position after the flow rate increasing.

21. The method of claim 19, further comprising expanding the plug seat in response to the piston displacing.

22. The method of claim 14, further comprising, after the equipment is stuck in the well, deploying the jarring tool into a tubular string in the well.

23. The method of claim 22, further comprising engaging the jarring tool with another jarring tool previously deployed into the tubular string.

24. The method of claim 22, in which the flow rate increasing comprises the pressure differential forcing the plug to displace through the plug seat of the jarring tool.

25. The method of claim 22, in which the flow rate increasing comprises the pressure differential displacing the piston from a bore of the jarring tool.

26. The method of claim 14, in which the flow rate increasing comprises permitting flow through a port of the jarring tool.

27. The method of claim 26, in which the port is formed through a wall of a mandrel of the jarring tool, the plug seat is formed in the mandrel, and the mandrel displaces from a first position to a second position in response to the pressure differential applying, flow through the port being permitted when the mandrel displaces to the second position.

28. The method of claim 14, in which the flow rate increasing comprises eroding the plug.

29. The method of claim 28, in which the eroding comprises permitting the fluid to flow between the plug and the plug seat of the jarring tool.

30. The method of claim 14, in which the flow rate increasing comprises opening a valve.

31. The method of claim 30, in which opening the valve comprises controlling fluid communication with the first flow passage section.

32. The method of claim 30, in which opening the valve comprises controlling fluid communication between the first and second flow passage sections.

33. The method of claim 30, in which opening the valve comprises controlling fluid communication between the first flow passage section and an exterior of the jarring tool.

34. The method of claim 14, in which the flow rate increasing comprises increasing the flow rate from the first flow passage section to the second flow passage section.

* * * * *